US012467456B2

(12) United States Patent
Moon et al.

(10) Patent No.: US 12,467,456 B2
(45) Date of Patent: Nov. 11, 2025

(54) SCROLL COMPRESSOR

(71) Applicant: LG ELECTRONICS INC., Seoul (KR)

(72) Inventors: Jehyeon Moon, Seoul (KR); Byungkil Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/277,423

(22) PCT Filed: Jan. 18, 2022

(86) PCT No.: PCT/KR2022/000902
§ 371 (c)(1),
(2) Date: Aug. 16, 2023

(87) PCT Pub. No.: WO2022/177176
PCT Pub. Date: Aug. 25, 2022

(65) Prior Publication Data

US 2024/0301880 A1 Sep. 12, 2024

(30) Foreign Application Priority Data

Feb. 19, 2021 (KR) ..... 10-2021-0022582

(51) Int. Cl.
*F04C 18/02* (2006.01)
*F04C 27/00* (2006.01)
(Continued)

(52) U.S. Cl.
CPC ..... *F04C 18/0215* (2013.01); *F04C 18/0261* (2013.01); *F04C 18/0292* (2013.01);
(Continued)

(58) Field of Classification Search
CPC ..... F04C 18/0215; F04C 18/0292; F04C 29/0028; F04C 23/008; F04C 27/005; F04C 18/0261; F04C 28/26; F04C 18/0253
See application file for complete search history.

(56) References Cited

U.S. PATENT DOCUMENTS 8,998,595 B2 4/2015 Ito et al.
11,781,546 B1 * 10/2023 Jo ..... F04D 27/0215 418/55.1
(Continued)

FOREIGN PATENT DOCUMENTS

CN 103032329 4/2013
CN 103384769 11/2013
(Continued)

OTHER PUBLICATIONS

JP-2012092773-A, English Language machine translation (Year: 2012).*
(Continued)

*Primary Examiner* — Wesley G Harris
(74) *Attorney, Agent, or Firm* — KED & ASSOCIATES

(57) ABSTRACT

A scroll compressor including an orbiting scroll that performs an orbiting motion; a fixed scroll coupled to the orbiting scroll so as to form a compression chamber; and a main frame that rotatably supports the orbiting scroll at an opposite side of the fixed scroll with the orbiting scroll interposed therebetween, and supportably connected to the fixed scroll. The fixed scroll is provided with a back pressure hole formed between a first back pressure chamber in which gas discharged from the compression chamber is received, and the compression chamber. The back pressure hole may communicate with the first back pressure chamber and the
(Continued)

compression chamber on the basis of a predetermined pressure ratio of the compression chamber.

25 Claims, 15 Drawing Sheets

(51) Int. Cl.
*F04C 29/00* (2006.01)
*F04C 23/00* (2006.01)

(52) U.S. Cl.
CPC ..... *F04C 27/005* (2013.01); *F04C 29/0028* (2013.01); *F04C 23/008* (2013.01); *F04C 29/0021* (2013.01)

(56) References Cited

U.S. PATENT DOCUMENTS

2007/0092390 A1* 4/2007 Ignatiev ..... F04C 29/0007 418/55.1
2010/0089093 A1* 4/2010 Kim ..... F04C 29/028 418/55.6
2010/0215535 A1* 8/2010 Kiyokawa ..... F04C 23/008 418/55.1
2010/0226807 A1* 9/2010 Sato ..... F04C 27/005 418/55.1
2012/0164014 A1* 6/2012 Nagahara ..... F04C 18/0261 418/55.1
2013/0078131 A1* 3/2013 Ahn ..... F04C 18/0215 418/55.6
2013/0343941 A1* 12/2013 Kim ..... F04C 29/023 418/55.1
2014/0010693 A1* 1/2014 Imada ..... F04C 29/12 418/55.2
2018/0372103 A1* 12/2018 Choi ..... F04C 27/005
2019/0242384 A1* 8/2019 Yoo ..... F04C 18/0261
2022/0136501 A1* 5/2022 Yun ..... F04C 18/0253 418/55.2
2024/0077080 A1* 3/2024 Jo ..... F04C 18/0261

FOREIGN PATENT DOCUMENTS

| | | | | |
|---|---|---|---|---|
| CN | 103459851 | | 12/2013 | |
| EP | 0534891 | | 3/1993 | |
| JP | 2012092773 | A * | 5/2012 | ..... F04C 18/0215 |
| JP | 2013-256919 | | 12/2013 | |
| JP | 6302813 | | 3/2018 | |
| JP | 2018-119505 | | 8/2018 | |
| JP | 6722877 | | 7/2020 | |
| KR | 10-1474460 | | 12/2014 | |
| KR | 10-2018-0072302 | | 6/2018 | |
| WO | WO-2016052503 | A1 * | 4/2016 | ..... F04C 18/0215 |
| WO | WO 2018131235 | | 7/2018 | |
| WO | WO 2020008902 | | 1/2020 | |
| WO | WO 2021001923 | | 1/2021 | |

OTHER PUBLICATIONS

WO-2016052503-A1, English Language machine translation (Year: 2016).*
International Search Report dated Apr. 25, 2022 issued in Application No. PCT/KR2022/000902.
Korean Office Action dated Feb. 28, 2022 issued in Application No. 10-2021-0022582.
Korean Notice of Allowance dated Sep. 21, 2022 issued in Application No. 10-2021-0022582.
Chinese Office Action dated Sep. 24, 2025, issued in Application No. 202280009497.6.

* cited by examiner

SCROLL COMPRESSOR

CROSS-REFERENCE TO RELATED APPLICATIONS

This application is the National Stage filing under 35 U.S.C. 371 of International Application No. PCT/KR2022/000902, filed on Jan. 18, 2022, which claims the benefit of earlier filing date of and rights of priority to Korean Application 10-2021-0022582 filed on Feb. 19, 2021, the contents of which are all hereby incorporated by reference herein in their entirety.

TECHNICAL FIELD

A scroll compressor, and more particularly, a scroll compressor having a structure such that pressure in a back pressure chamber in a high-pressure scroll compressor is varied according to operating conditions is disclosed herein.

BACKGROUND ART

A scroll compressor is configured such that an orbiting scroll and a non-orbiting scroll are engaged with each other and a pair of compression chambers is formed while the orbiting scroll performs an orbiting motion with respect to the non-orbiting scroll. The compression chamber includes a suction pressure chamber formed at an outer side, an intermediate pressure chamber continuously formed toward a central portion from the suction pressure chamber while gradually decreasing in volume, and a discharge pressure chamber connected to a center of the intermediate pressure chamber. Typically, the suction pressure chamber is formed through a side surface of the non-orbiting scroll, the intermediate pressure chamber is sealed, and the discharge pressure chamber is formed through an end plate of the non-orbiting scroll.

Scroll compressors may be classified into a low-pressure type and a high-pressure type according to a path through which refrigerant is suctioned. The low-pressure type is configured such that a refrigerant suction pipe is connected to an inner space of a casing to guide suctioned refrigerant at a low temperature to flow into a suction pressure chamber via the inner space of the casing. On the other hand, the high-pressure type is configured such that the refrigerant suction pipe is connected directly to the suction pressure chamber to guide refrigerant to flow directly into the suction pressure chamber without passing through the inner space of the casing.

In a case of a scroll compressor in the related art, a check valve is installed and a back pressure hole is processed to adjust the pressure in the back pressure chamber. U.S. Pat. No. 8,998,595 (hereinafter, "Patent Document 1"), registered on Apr. 7, 2015, discloses a low-pressure type scroll compressor for vehicles configured such that a hole capable of communicating with an upper end of an orbiting scroll wrap and a back pressure chamber is provided. In such a case that the back pressure is insufficient, when the orbiting scroll moves backward, a high-pressure refrigerant flows into the back pressure chamber through a gap between an orbiting scroll and a fixed scroll wrap. When the pressure in the back pressure chamber rises, the orbiting scroll comes back into contact with the fixed scroll, thereby preventing leakage of the refrigerant between compression chambers.

However, the scroll compressor disclosed in Patent Document 1 is applicable to a low-pressure type scroll structure, but not applicable to a high-pressure scroll compressor.

Therefore, there is a need to develop structure configured such that a pressure in a back pressure chamber is varied to be applicable to a high-pressure type scroll compressor.

In addition, a scroll compressor having structure in which a hole is processed in a bottom portion of a fixed scroll to communicate with the back pressure chamber at a particular pressure ratio so that a flow is made into a back pressure chamber located outside of an orbiting scroll back pressure chamber to constitute a pressure is also known. In this scroll compressor, when operating conditions are changed due to communication at a particular pressure ratio, a pressure in the back pressure chamber is changed, and thus, performance of the scroll compressor may be greatly changed.

Therefore, an orbiting scroll actively moves in an axial direction by a relationship of forces between a back pressure chamber and a compression chamber regardless of operating conditions. Accordingly, there is a need to develop a scroll compressor that may maintain constant performance in most operating regions.

Japanese Laid-open Patent Publication No. 2013-256919 (hereinafter, "Patent Document 2"), published on Dec. 26, 2013, discloses a scroll compressor having structure in which an intermediate pressure communication hole is defined in a rear surface of a fixed scroll. In structure of back pressure combined with discharge pressure and intermediate pressure, an end plate periphery of an orbiting scroll is a space under an intermediate pressure.

In addition, Patent Document 2 discloses a thrust groove structure for preventing high-pressure oil from leaking into a compression chamber intake with respect to a structure in which high-pressure oil is supplied into a thrust groove in a fixed scroll to offset excessive back pressure. Patent Document 2 discloses a groove through which high-pressure oil may flow to offset back pressure when the back pressure is excessive.

However, according to Patent Document 2, back pressure is not adjustable according to operating conditions, and thus, proper operation may not be performed when the back pressure is low. Accordingly, there is a need for developing a scroll compressor having an active structure capable of adjusting a back pressure according to operating conditions such that the scroll compressor does not operate when the back pressure is excessive but operates when the back pressure is low.

DISCLOSURE OF INVENTION

Technical Problem

Embodiments disclosed herein have been made to solve the above problems, and embodiments disclosed herein provide a scroll compressor having structure such that pressure in a back pressure chamber is varied according to operating conditions in a high-pressure scroll compressor.

Embodiments disclosed herein further provide a scroll compressor in which an orbiting scroll actively moves in an axial direction due to a relationship of forces between a back pressure chamber and a compression chamber regardless of operating conditions to thereby have constant performance in most operation areas.

Embodiments disclosed herein furthermore provide a scroll compressor having structure in which pressures in a primary back pressure chamber and a secondary back pressure chamber are varied.

Embodiments disclosed herein additionally provide a scroll compressor having active structure capable of adjusting a back pressure according to operating conditions such that the scroll compressor does not operate when the back pressure is excessive and operates when the back pressure is low.

Solution to Problem

Embodiments disclosed herein provide a scroll compressor including an orbiting scroll configured to perform an orbital motion; a fixed scroll coupled to the orbiting scroll to define a compression chamber; and a main frame configured to rotatably support the orbiting scroll at an opposite side of the fixed scroll with the orbiting scroll interposed therebetween, and supportably connected to the fixed scroll. The fixed scroll is provided with a back pressure hole disposed between the compression chamber and a first back pressure chamber in which gas discharged from the compression chamber is received, and the back pressure hole is capable of communicating with the first back pressure chamber and the compression chamber on a basis of a predetermined pressure ratio of the compression chamber.

The back pressure hole may include a first flow path disposed in a direction parallel to an upward direction and a second flow path disposed to be capable of communicating with the first flow path and in a direction parallel to a lateral direction. In addition, the flow path may include a compression communication flow path into which the gas discharged from the compression chamber flows and a back pressure communication flow path communicating with the compression communication flow path and disposed to be capable of communicating with the first back pressure chamber to provide gas flowing through the compression communication flow path into the first back pressure chamber. The second flow path may be disposed between the compression communication flow path and the back pressure communication flow path.

A guide inlet portion configured to guide the discharged gas to flow into the first back pressure chamber and communicate with the back pressure hole may be disposed on a lower surface of the fixed scroll. In addition, the second flow path may include a pressure control pin capable of controlling flow of the gas into the first back pressure chamber. The first back pressure chamber may be disposed between an upper surface of the main frame, a side portion of the orbiting scroll, and a lower surface of the fixed scroll.

The orbiting scroll may include an orbiting end plate having a disc shape with a predetermined width and supporting the fixed scroll. The first and second flow paths may be disposed on an inner side of the fixed scroll with reference to an outer diameter of the orbiting end plate.

An end plate groove may be disposed in a side portion of one surface of the orbiting end plate along a circumferential direction. The end plate groove may be disposed in a position in which the end plate groove is capable of communicating with the back pressure hole during an orbiting motion of the orbiting scroll.

The end plate groove may be provided in plurality on one surface of the orbiting end plate. The plurality of end plate grooves may be disposed to be symmetrical to each other with reference to a center of the orbiting end plate.

As pressure outside of the fixed scroll is decreased, when the orbiting scroll moves backward in an axial direction, gas may flow into the end plate groove and pressure in the first back pressure chamber may rise. The orbiting end plate may be pressed in an axial direction to be capable of being coupled to the fixed scroll.

A distance from one side of the end plate groove to an outer portion of the compression chamber may be greater than a distance from another side of the end plate groove to an outer circumference of the orbiting end plate. The end plate groove may be disposed adjacent to an outer circumference of the orbiting end plate to be apart therefrom by a sealing distance.

The orbiting scroll may include an orbiting end plate having a disc shape with a predetermined width and supporting the fixed scroll, and a second back pressure chamber having a width corresponding to a predetermined distance from a center of the orbiting end plate may be disposed below the orbiting end plate, and a back pressure opening in communication with the second back pressure chamber and a lower surface of the fixed scroll may be disposed in the orbiting end plate. The back pressure opening may include a first passage disposed in a direction parallel to an upward direction, and a second passage disposed to be capable of communicating with the first passage and in a direction parallel to a lateral direction.

The first passage may include a back pressure chamber communication flow path into which gas discharged from the second back pressure chamber flows, and a fixed communication flow path communicating with the back pressure chamber communication flow path, and disposed to be capable of communicating with a lower surface of the fixed scroll to provide gas flowing through the back pressure chamber communication flow path to the lower surface of the fixed scroll. A fixing groove may be disposed in a lower surface of the fixed scroll to be capable of communicating with the fixed communication flow path. In addition, a pressure control pin capable of controlling gas leakage from the second back pressure chamber may be disposed in the second passage.

Embodiments disclosed herein provide a scroll compressor including an orbiting scroll configured to perform an orbital motion; a fixed scroll coupled to the orbiting scroll to define a compression chamber; a main frame configured to rotatably support the orbiting scroll at an opposite side of the fixed scroll with the orbiting scroll interposed therebetween, and supportably connected to the fixed scroll; and a casing in which the orbiting scroll, the fixed scroll, and the main frame are received. The fixed scroll is provided with a back pressure hole disposed between the compression chamber and a first back pressure chamber in which gas discharged from the compression chamber is received, and the back pressure hole is capable of communicating with the first back pressure chamber and the compression chamber on a basis of a predetermined pressure ratio of the compression chamber.

The back pressure hole may include a first flow path disposed in a direction parallel to an upward direction and a second flow path disposed to be capable of communicating with the first flow path and in a direction parallel to a lateral direction. The first flow path may include a compression communication flow path into which the gas discharged from the compression chamber flows and a back pressure communication flow path communicating with the compression communication flow path and disposed to be capable of communicating with the first back pressure chamber to provide gas flowing through the compression communication flow path into the first back pressure chamber.

A guide inlet portion configured to guide the discharged gas to flow into the first back pressure chamber and communicate with the back pressure hole may be disposed on a lower surface of the fixed scroll. The second flow path may include a pressure control pin capable of controlling flow of the gas into the first back pressure chamber.

The orbiting scroll may include an orbiting end plate having a disc shape with a predetermined width and supporting the fixed scroll. The first and second flow paths may be disposed on an inner side of the fixed scroll with reference to an outer diameter of the orbiting end plate.

An end plate groove may be disposed in a side portion of one surface of the orbiting end plate along a circumferential direction. The end plate groove may be disposed in a position in which the end plate groove is capable of communicating with the back pressure hole during an orbiting motion of the orbiting scroll.

The orbiting scroll may include an orbiting end plate having a disc shape with a predetermined width and supporting the fixed scroll, a second back pressure chamber having a width corresponding to a predetermined distance from a center of the orbiting end plate may be disposed below the orbiting end plate, and a back pressure opening in communication with the second back pressure chamber and a lower surface of the fixed scroll may be disposed in the orbiting end plate. The back pressure opening may include a first passage disposed in a direction parallel to an upward direction and a second passage disposed to be capable of communicating with the first passage and in a direction parallel to a lateral direction.

The first passage may include a back pressure chamber communication flow path into which gas discharged from the second back pressure chamber flows, and a fixed communication flow path communicating with the back pressure chamber communication flow path, and disposed to be capable of communicating with a lower surface of the fixed scroll to provide gas flowing through the back pressure chamber communication flow path to the lower surface of the fixed scroll. A fixing groove may be disposed in a lower surface of the fixed scroll to be capable of communicating with the fixed communication flow path.

Advantageous Effects of Invention

A scroll compressor according to embodiments disclosed herein is configured such that an orbiting scroll may actively move in an axial direction according to a relationship of forces between a compression chamber and a back pressure chamber. Thus, the scroll compressor may have constant performance in most operating regions.

In addition, in the scroll compressor according to embodiments disclosed herein, although a hole in an upper portion of a fixed scroll wrap is adjacent to a first back pressure chamber, the hole and the first back pressure chamber communicates with each other via a hole in an outer portion of the fixed scroll, that is, a hole drilled in a position closed by rotation of an orbiting scroll at all times. Thus, while the compressor is driven, when the orbiting scroll moves backward in an axial direction due to lower pressure in the first back pressure chamber, a gap is generated between an upper end of the fixed scroll wrap and a bottom portion of the orbiting scroll. When high-pressure gas flows into the first back pressure chamber through the gap, pressure in the first back pressure chamber rises and the orbiting scroll moves in an axial direction, thus maintaining sealing in the compression chamber to thereby increase efficiency of the scroll compressor.

MODE FOR THE INVENTION

Figure 1:
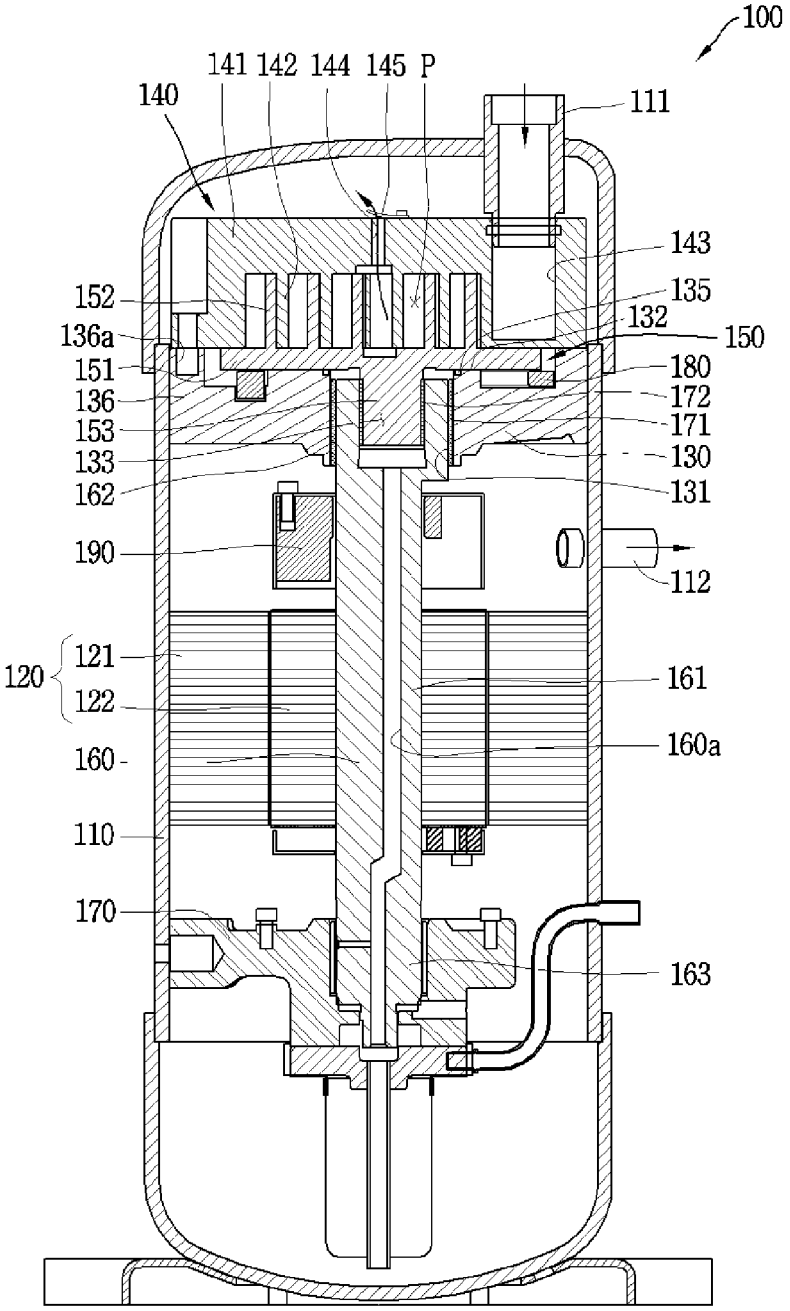
FIG. 1 is a cross-sectional view of a scroll compressor according to an embodiment.

Hereinafter, a description will be given of a scroll compressor 100 according to an embodiment, with reference to the accompanying drawings. For the sake of brief description with reference to the drawings, the same or equivalent components may be provided with the same or similar reference numbers, and description thereof will not be repeated.

In addition, structure that is applied to one embodiment will be equally applied to another embodiment as long as there is no structural and functional contradiction in the different embodiments.

A singular representation may include a plural representation unless it represents a definitely different meaning from the context.

In describing embodiments disclosed herein, when a detailed explanation for a related known function or construction is considered to unnecessarily divert the gist, such explanation has been omitted but would be understood by those skilled in the art.

The accompanying drawings are used to help easily understand the technical idea of the embodiments disclosed herein and it should be understood that the idea of the embodiments disclosed herein is not limited by the accompanying drawings. The idea of the embodiments disclosed herein should be construed to extend to any alterations, equivalents and substitutes besides the accompanying drawings.

A description will now be given in detail of a scroll compressor 100 according to one embodiment disclosed herein, with reference to the accompanying drawings. The scroll compressor 100 includes an orbiting scroll 150 configured to perform an orbiting motion, a fixed scroll 140 coupled to the orbiting scroll 150 to form a compression chamber P, and a main frame 130 configured to rotatably support the orbiting scroll 150 at an opposite side of the fixed scroll 140 with the orbiting scroll 150 interposed therebetween, and supportably connected to the fixed scroll 140.

The fixed scroll 140 includes a back pressure hole 146 between the compression chamber P and a first back pressure chamber 137*a* that receives gas discharged from the compression chamber P therein. In addition, the back pressure hole 146 may communicate with the first back pressure chamber 137*a* and the compression chamber P based on a pressure ratio predetermined for the compression chamber P.

As will be described hereinafter, in the scroll compressor 100 according to embodiments disclosed herein, as the orbiting scroll 150 actively moves in an axial direction by a relationship of forces between a back pressure chamber and the compression chamber regardless of operating conditions, constant performance may be exhibited in most operating regions.

In addition, in the scroll compressor 100 according to embodiments disclosed herein, although a hole in an upper portion of a fixed scroll wrap 142 (hereinafter, referred to as a "fixed wrap") is adjacent to the first back pressure chamber 137*a*, the hole and the first back pressure chamber 137*a* communicate with each other via a hole in an outer portion in the fixed scroll 140, that is, a hole drilled in a position closed by rotation of the orbiting scroll 150 at all times. Thus, while the compressor is driven, when the orbiting scroll 150 moves backward in the axial direction due to lower pressure in the first back pressure chamber 137*a*, a gap is generated between an upper end of the fixed wrap 142 and a bottom portion of the orbiting scroll 150. When high-pressure gas flows into the first back pressure chamber 137*a* through the gap, pressure in the first back pressure chamber rises and the orbiting scroll 150 moves in the axial direction, thus maintaining sealing in the compression chamber P to thereby increase efficiency of the scroll compressor 100.

Structures of the first back pressure chamber 137*a* and the back pressure hole 146 will be described hereinafter.

As illustrated in FIG. 1, the scroll compressor 100 according to embodiments disclosed herein may further include a casing 110 that receives the orbiting scroll 150, the fixed scroll 140, and the main frame 130 therein. The casing 110 is configured to have a sealed inner space. For example, the casing 110 may have a cylindrical shape.

A drive motor 120 including a stator 121 and a rotor 122 may be disposed in the casing 110. The stator 121 is fixed to an inner circumferential surface of the casing 110 in a shrink-fitting method, and the rotor 122 is rotatably disposed inside of the stator 121.

Although not clearly shown in the drawing, a coil may be wound around the stator 121, and the coil may be electrically connected to an external power source through a terminal (not shown) coupled through the casing 110. A rotational shaft 160 is eccentrically coupled to a center of the rotor 122.

As shown in FIG. 1, a main bearing 171 that supports the rotational shaft 160 in a radial direction is press-fitted to an upper portion of the rotational shaft 160. The first bearing 171 may be coupled between the main frame 130, the orbiting scroll 150, and the rotational shaft 160 to allow rotation of the rotational shaft 160. For example, the first bearing 171 may be configured with a bush bearing.

A lower end portion of the rotational shaft 160 is rotatably coupled into a sub frame 170, thereby allowing the rotational shaft 160 to rotate while being supported in the radial direction by the main frame 130 and the sub frame 170 described above. The main bearing 171 and the sub bearing (not shown) that support the rotational shaft 160 are coupled into the main frame 130 and the sub frame 170, respectively. For example, each of the main bearing 171 and the sub bearing may be a bush bearing.

The main frame 130 rotatably supports the orbiting scroll 150 at an opposite side of the fixed scroll 140 with the orbiting scroll 150 therebetween, and is supportably connected to the fixed scroll 140. The main frame 130 may be equipped with a scroll fixing portion 136 that may supportably fix the fixed scroll 140. Further, the scroll fixing portion 136 may include a fastening hole 136*a* for fixing the fixed scroll 140.

A plurality of scroll fixing portions 136 may be disposed along a circumferential direction of the main frame 130. Although FIG. 1 only illustrates scroll fixing portions 136 provided on both left and right sides of the main frame 130, and does not clearly show a number of the scroll fixing portions 136, four or five scroll fixing portions 136, for example, may be disposed along the circumferential direction of the main frame 130.

In addition, the main frame 130 includes an orbiting space portion 133, which is a space disposed therein to accommodate rotational shaft coupling portion 153 to perform an orbital motion, and a scroll support surface 132 disposed around the orbiting space portion 133 to have a predetermined width on an upper surface of the main frame 130. The orbiting space portion 133 may be configured as a cylindrical space, for example. Further, the scroll support surface 132 may be disposed along the circumferential direction around the orbiting space portion 133.

The orbiting scroll 150 is configured to perform an orbital motion. The rotational shaft coupling portion 153 protruding to be inserted into the rotational shaft 160 may be disposed on one surface of the orbiting scroll 150, the rotational shaft 160 being rotatable by power transmitted from outside.

FIG. 1 illustrates an example in which the rotational shaft coupling portion 153 protrudes from a lower surface of the orbiting end plate 151 of the orbiting scroll 150 described hereinafter. However, a shape of the rotational shaft coupling portion 153 is not necessarily limited to this structure, and may also have a boss-type structure. When the rotational shaft coupling portion 153 has the boss-type structure, structure in which an upper portion of the rotational shaft 160 is inserted into the rotational shaft coupling portion 153 having the boss-type structure may be provided.

In addition, the orbiting scroll 150 is disposed on an upper surface of the main frame 130. The orbiting scroll 150 performs an orbital motion between the main frame 130 and the fixed scroll 140 described hereinafter. The orbiting scroll 150 according to an embodiment includes the orbiting end plate 151 having a disk shape and an orbiting wrap 152 spirally disposed on one side surface of the orbiting end plate 151.

Figure 2:
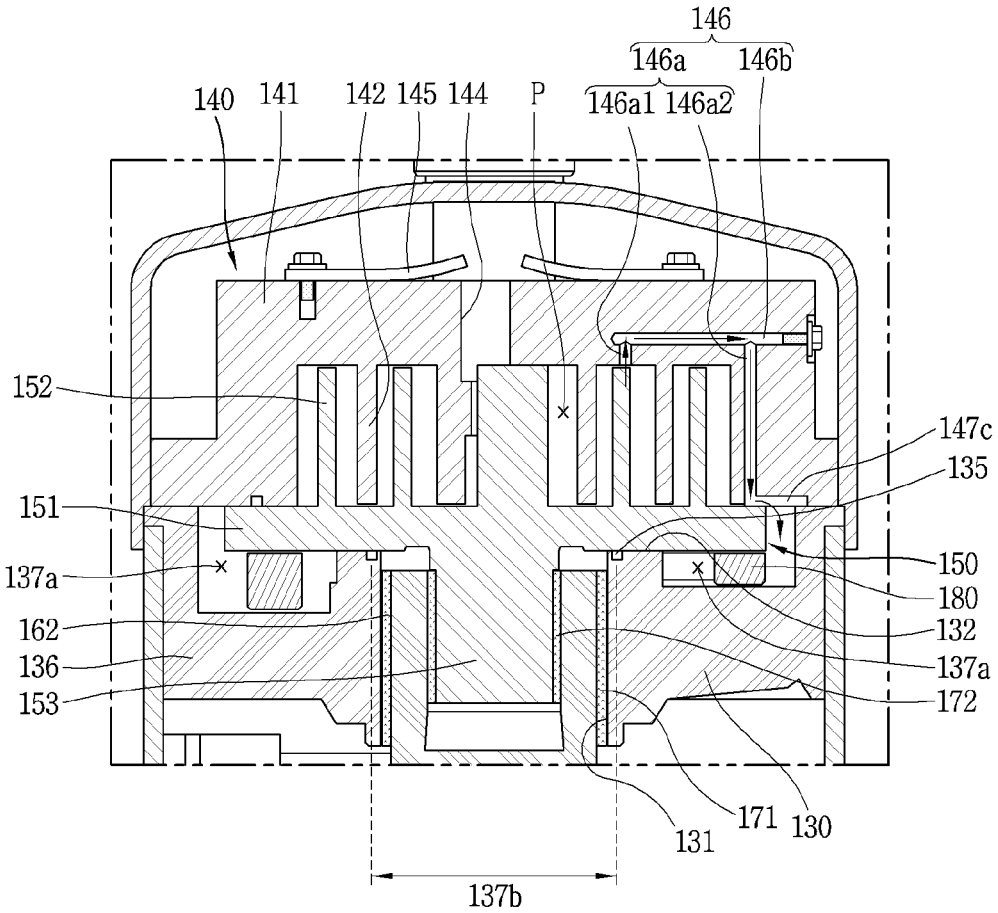
FIG. 2 is an enlarged cross-sectional view illustrating an example in which a back pressure hole is disposed on one side of a fixed scroll of the scroll compressor according to an embodiment.
Figure 5:
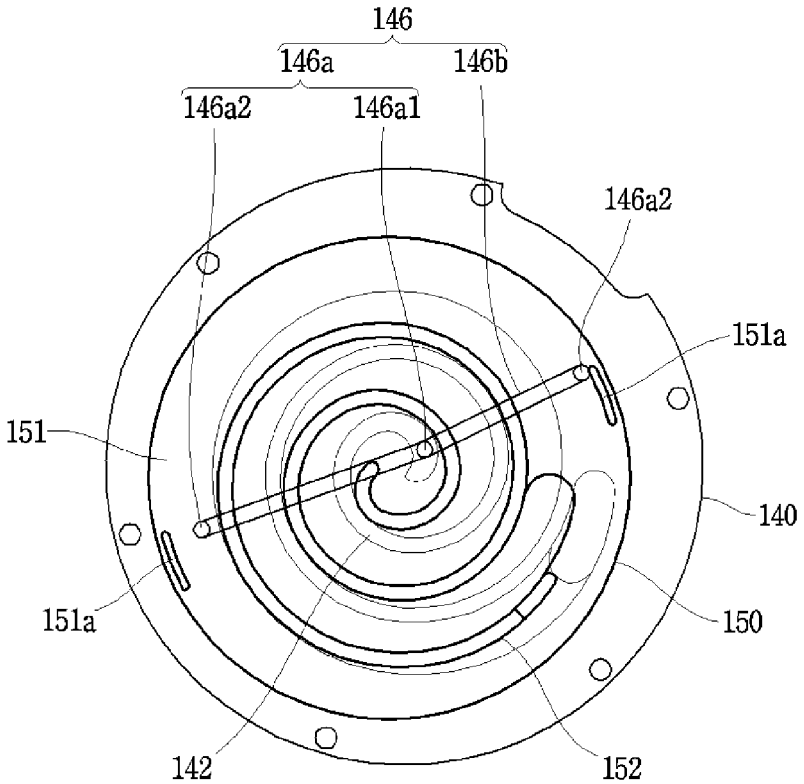
FIG. 5 is a planar view of the fixed scroll and an orbiting scroll as viewed from a top.

FIGS. 2 and 5 show examples of the orbiting end plate 151 having a disk shape with a predetermined width, and the orbiting wrap 152 configured such that a helical section extends upwardly from an upper surface of the orbiting end plate 151. The orbiting wrap 152 may define the compression chamber P together with the fixed wrap 142 described hereinafter.

The compression chamber P may include a first compression chamber (not shown) defined on an outer surface and a second compression chamber (not shown) defined on an inner surface with reference to the fixed wrap 142 described hereinafter. In the first compression chamber and the second compression chamber, a suction pressure chamber (not shown), an intermediate pressure chamber (not shown), and a discharge pressure chamber (not shown) are consecutively disposed, respectively.

The rotational shaft coupling portion 153 coupled to the rotational shaft 160 is provided on a lower surface of the orbiting end plate 151, thereby allowing the orbiting scroll 150 to perform an orbital rotation by the rotation of the rotational shaft 160. An orbiting bearing 172 may be provided between an inner circumference of the rotational shaft coupling portion 153 and an outer circumference of the rotational shaft 160. An Oldham ring 180 may be disposed between the fixed scroll 140 and the orbiting scroll 150 to prevent rotation of the orbiting scroll 150.

The back pressure hole 146 is disposed in the fixed scroll 140. The back pressure hole 146 is configured to be disposed between the first back pressure chamber 137*a* and the compression chamber P. The first back pressure chamber 137*a* is a space in which gas discharged from the compression chamber P is received. For example, the first back pressure chamber 137*a* may be disposed between an upper surface of the main frame 130, a side portion of the orbiting scroll 150, and a lower surface of the fixed scroll 140.

FIG. 2 illustrates an example in which the first back pressure chamber 137*a* is disposed between left and right or lateral upper surfaces of the main frame 130, both left and right or lateral sides of the orbiting scroll 150, and both lower surfaces of the fixed scroll 140. Although FIG. 2 shows that the first back pressure chamber 137*a* is disposed on both left and right sides, the first back pressure chamber 137*a* may be understood as one space defined between the main frame 130, the orbiting scroll 150, and the fixed scroll 140 along the circumferential direction.

In addition, the back pressure hole 146 may communicate with the first back pressure chamber 137*a* and the compression chamber P based on a predetermined pressure ratio in the compression chamber P. The back pressure hole 146 may include a first flow path 146*a* and a second flow path 146*b*. The first flow path 146*a* may be disposed or extend in a direction parallel to an upward direction.

In addition, the first flow path 146*a* may include a compression communication flow path 146*a*1 into which gas discharged from the compression chamber P flows, and a back pressure communication flow path 146*a*2 disposed to communicate with the compression communication flow path 146*a*1 and configured to be communicable with the first back pressure chamber 137*a* to supply gas flowing through the compression communication flow path 146*a*1 to the first back pressure chamber 137*a*.

As illustrated in FIG. 2, the compression communication flow path 146*a*1 communicates upwardly with the compression chamber P to allow the gas discharged from the compression chamber P to flow therethrough and move upward. The back pressure communication flow path 146*a*2 communicates between the second flow path 146*b* and the first back pressure chamber 137*a* to allow the gas supplied through the second flow path 146*b* to flow downward to be supplied to the first back pressure chamber 137*a*. The second flow path 146*b* may be disposed to communicate with the first flow path 146*a* in a direction parallel to a lateral direction.

FIG. 2 shows an example in which gas provided from the first flow path 146*a* through the second flow path 146*b* may flow in a rightward (first lateral) direction. A guide inlet portion (guide inlet) 147*c* configured to guide the discharged gas to flow into the first back pressure chamber 137*a* and communicate with the back pressure hole 146 may be disposed on a lower surface of the fixed scroll 140.

Figure 3:
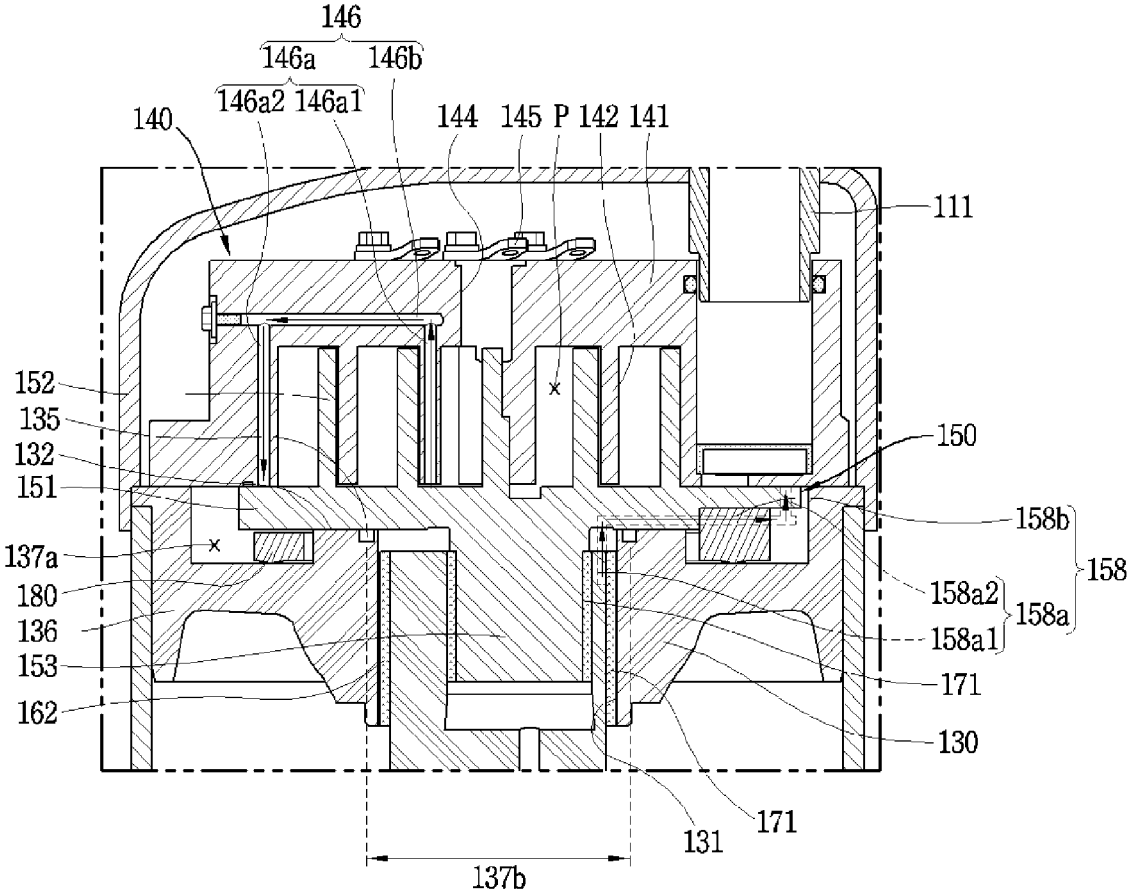
FIG. 3 is an enlarged cross-sectional view illustrating an example in which a back pressure hole is disposed on another side of the fixed scroll of the scroll compressor according to an embodiment.
Figure 4:
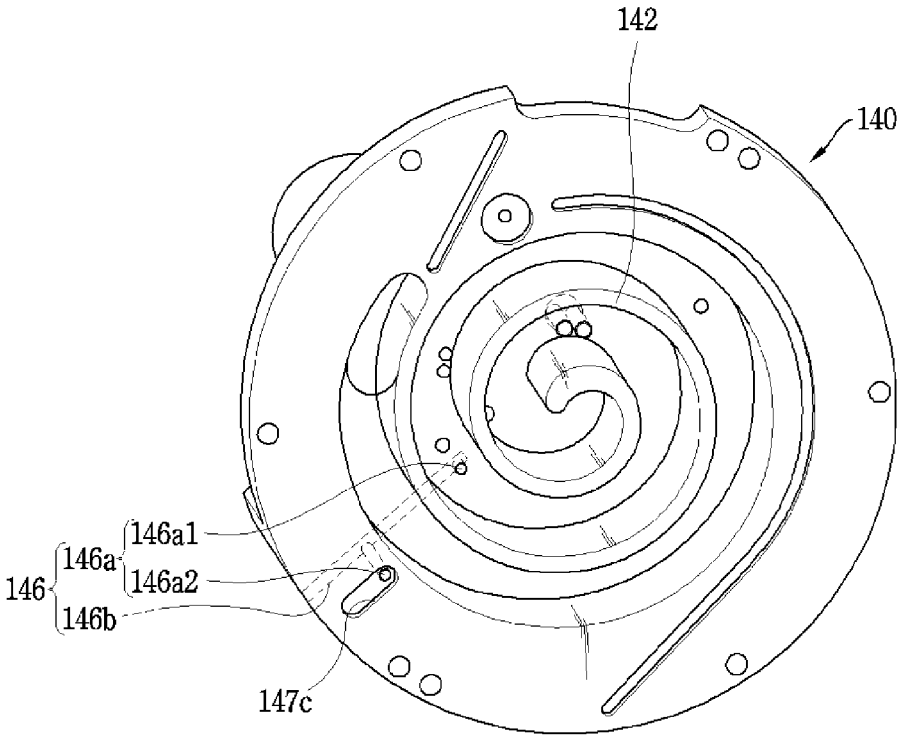
FIG. 4 is a perspective view of the fixed scroll of the scroll compressor according to an embodiment, the fixed scroll as viewed from a bottom.

FIGS. 2 and 4 show examples in which the guide inlet portion 147*c* is disposed on a lower right surface of the fixed scroll 140 to communicate with the back pressure hole 146 to guide the discharged gas to flow into the first back pressure chamber 137*a*. FIG. 4 shows an example of the guide inlet portion 147*c* having an elliptical shape. FIG. 3 also illustrates, unlike FIG. 2, that the back pressure hole 146 is disposed on a left side of the fixed scroll 140, and also illustrates an example in which the first flow path 146*a* is disposed in a direction parallel to an upward direction, and includes the compression communication flow path 146*a*1 into which the gas discharged from the compression chamber P flows and the back pressure communication flow path 146*a*2 disposed to communicate with the first back pressure chamber 137*a*.

In addition, the compression communication flow path 146*a*1 allows gas discharged from the compression chamber P to flow therein and allows gas introduced into the second flow path 146*b* to flow. The compression communication flow path 146*a*1 may allow the gas discharged from the compression chamber P to flow upward. The compression communication flow path 146*a*1 may be included inside of the fixed scroll 140, which is positioned adjacent to the rotational shaft 160.

The second flow path 146*b* may be disposed between the compression communication flow path 146*a*1 and the back pressure communication flow path 146*a*2. An example is shown in which the second flow path 146*b* is disposed in a leftward-rightward or lateral direction to communicate the compression communication flow path 146*a*1 with the back pressure communication flow path 146*a*2 on an upper side of the fixed scroll 140, FIGS. 3 and 4 illustrates an example in which the second flow path 146*b* is disposed on an upper side of the fixed scroll 140, and extends between the compression communication flow path 146*a*1 and the back pressure communication flow path 146*a*2 to have a minute circular section area extending in an upper portion of the fixed scroll 140. However, embodiments are not limited to circular section.

The back pressure communication flow path 146*a*2 communicates with the second flow path 146*b* and is disposed in parallel with the compression communication flow path 146*a*1. As shown in FIG. 3, the back pressure communication flow path 146*a*2 allows gas supplied from the second flow path 146*b* to flow downwards to be provided to the first back pressure chamber 137*a*. In addition, FIGS. 3 and 4 shows an example in which the back pressure communication flow path 146*a*2 is disposed in an inner portion with reference to an outer diameter of the orbiting end plate 151, that is, in an outer portion compared to the compression communication flow path 146*a*1.

FIG. 3 illustrates an example in which the back pressure hole 146 is disposed on a left (first lateral) side of the fixed scroll 140. FIG. 4 shows an example in which the compression communication flow path 146*a*1, the second flow path 146*b*, and the back pressure communication flow path 146*a*2 have a shape of a micro-hole with a predetermined diameter.

FIG. 5 illustrates the orbiting end plate 151 and the orbiting wrap 152 each included in the orbiting scroll 150, and the fixed wrap 142. An example in which the compression communication flow path 146*a*1 is disposed in the fixed wrap 142 placed at one position near a center of the orbiting scroll 150 and the back pressure communication flow path 146*a*2 is disposed on both sides of the fixed scroll 140 is shown. In addition, the second flow path 146*b* allows communication between the compression communication flow path 146*a*1 and the back pressure communication flow path 146*a*2, and is disposed in an upper portion of the fixed scroll 140 as described above.

The orbiting scroll 150 may include the orbiting end plate 151 having a disk shape with a predetermined width and supporting the fixed scroll 140. In addition, the first and second flow paths 146*b* may be disposed on an inner side of the fixed scroll 140 with reference to an outer diameter of the orbiting end plate 151.

An end plate groove 151*a* disposed along a circumferential direction may be included in a side portion of one surface of the orbiting end plate 151. The end plate groove 151*a* may be disposed at a position at which the end plate groove 151*a* may communicate with the back pressure hole 146 when the orbiting scroll 150 performs an orbital motion.

A plurality of end plate grooves 151*a* may be disposed in one surface of the orbiting end plate 151. The plurality of end plate grooves 151*a* may be disposed to be symmetrical to each other with reference to a center of the orbiting end plate 151.

In addition, as described above, the guide inlet portion 147*c* configured to guide the discharged gas to flow into the first back pressure chamber 137*a* and communicate with the back pressure hole 146 may be disposed on a lower surface of the fixed scroll 140. The end plate grooves 151*a* may be disposed adjacent to an outer circumference of the orbiting end plate 151 to be spaced apart therefrom by a sealing distance. For example, the end plate grooves 151*a* may be disposed in an upper surface of the orbiting scroll 150 facing the fixed scroll 140.

Figure 6:
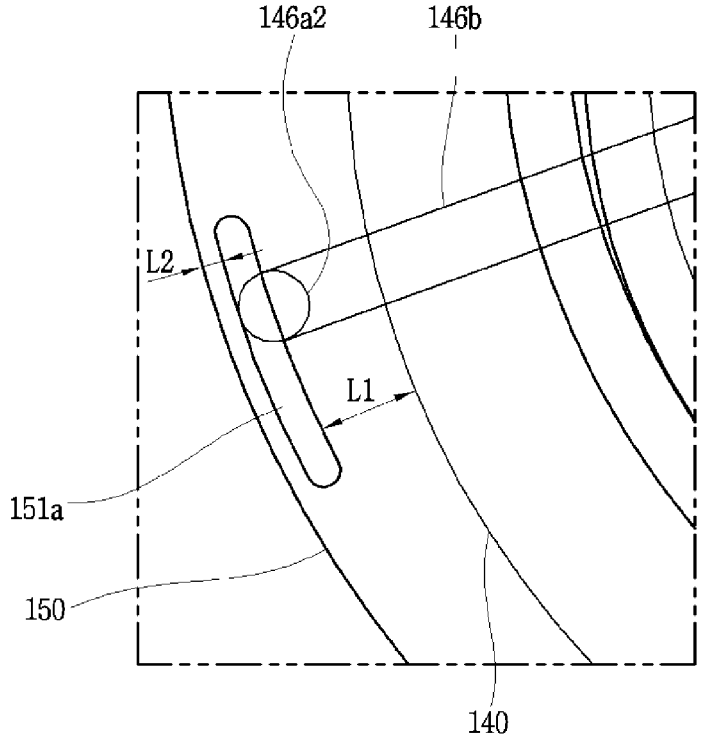
FIG. 6 is an enlarged view illustrating an example in which an end plate groove is disposed in an orbiting end plate of the orbiting scroll.

FIGS. 5 and 6 illustrate an example in which the end plate grooves 151*a* are disposed in the orbiting end plate 151 of the orbiting scroll 150 along the circumferential direction of the orbiting end plate 151. In this example, two end plate grooves 151*a* are disposed in the orbiting end plate 151 to be symmetrical to each other. The end plate grooves 151*a* may be configured to have a curvature to be parallel with a circumference of the orbiting end plate 151.

FIG. 6 shows the end plate groove 151*a* disposed almost adjacent to the back pressure communication flow path 146*a*2 of the back pressure hole 146. As described above, the end plate groove 151*a* needs to be disposed at a position at which the end plate groove 151*a* may communicate with the back pressure hole 146 when the orbiting scroll 150 performs an orbital motion.

A distance from one side of the end plate groove 151*a* to an outer portion of the compression chamber P may be greater than a distance from another side of the end plate groove 151*a* to an outer circumference of the orbiting end plate 151. For example, when a distance between the end plate groove 151*a* and the outer portion of the compression chamber is L1 and a distance between the end plate groove 151*a* and the outer circumference of the orbiting end plate 151 is L2, a configuration needs to be such that L1 is greater than L2, that is, to satisfy L1>L2. When the distance L1 between the end plate groove 151*a* and the outer portion of the compression chamber P is not greater than the distance L2 between the end plate groove 151*a* and the outer circumference of the orbiting end plate 151, high-pressure gas in the end plate groove 151*a* may enter a suction chamber having a short sealing distance, thus deteriorating efficiency of a compressor. That is, in relation to the embodiments disclosed herein, it should be understood that a sealing distance from an intermediate pressure space needs to be shorter than a distance from the compression chamber P at all times.

As pressure outside of the fixed scroll 140 is decreased, when the orbiting scroll 150 moves backward in the axial direction, gas flows into the end plate groove 151*a* and the pressure in the first back pressure chamber 137*a* rises. Thus, the orbiting scroll 150 may press the orbiting end plate 151 in the axial direction to be coupled to the fixed scroll 140.

Figure 7:
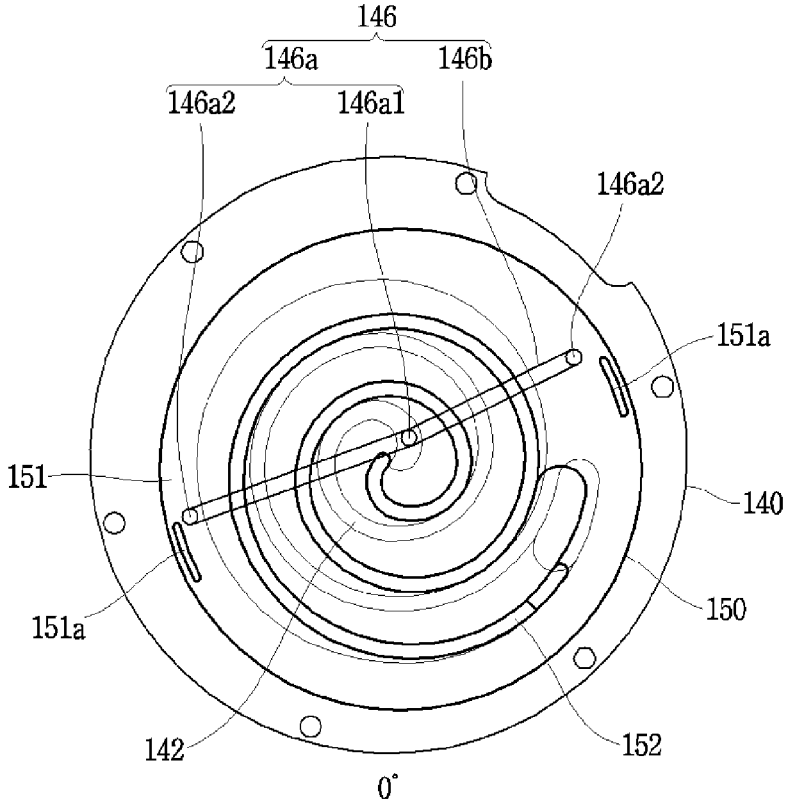
FIG. 7 is a planar view illustrating an example in which the orbiting scroll is disposed at a (first) position relative to the fixed scroll.
Figure 8:
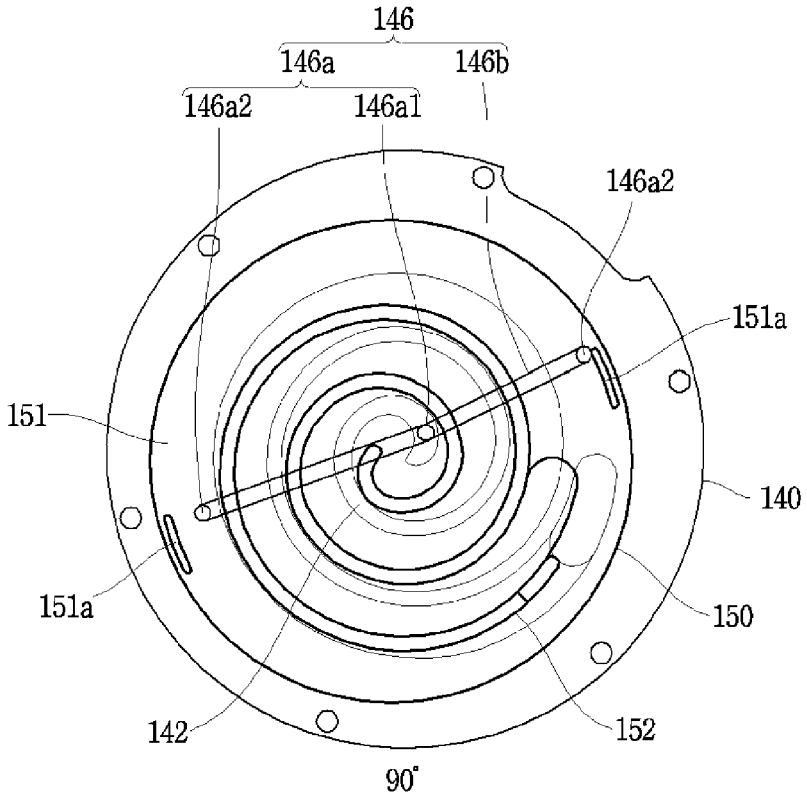
FIG. 8 is a planar view illustrating an example in which the orbiting scroll is disposed at a (second) position obtained by performing an orbital rotation from the position of FIG. 7 by a predetermined angle relative to the fixed scroll.
Figure 9:
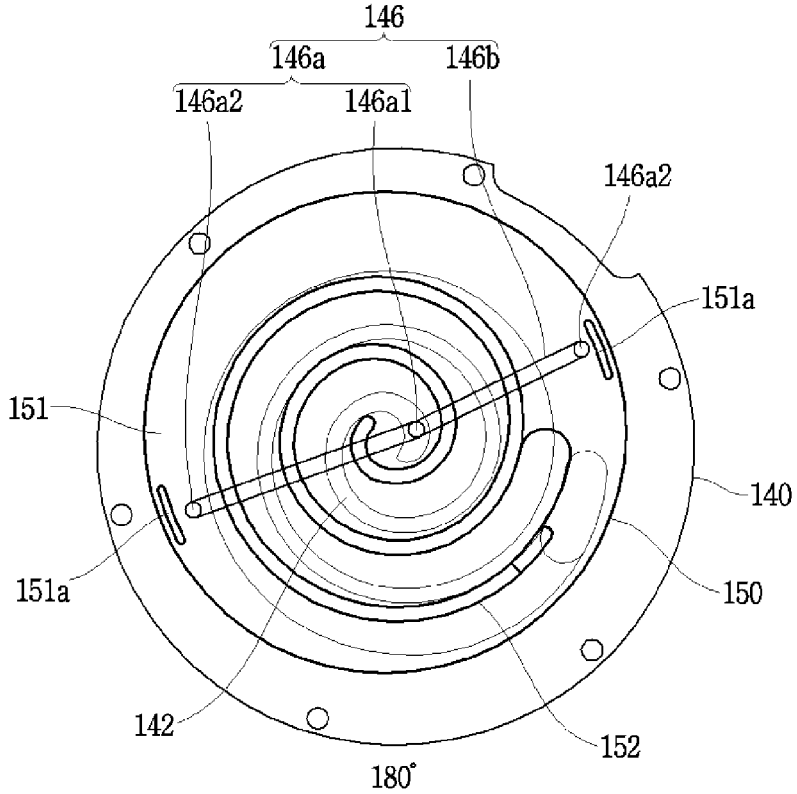
FIG. 9 is a planar view illustrating an example in which the orbiting scroll is disposed at a (third) position obtained by performing an orbital rotation from the position of FIG. 8 by a predetermined angle relative to the fixed scroll.
Figure 10:
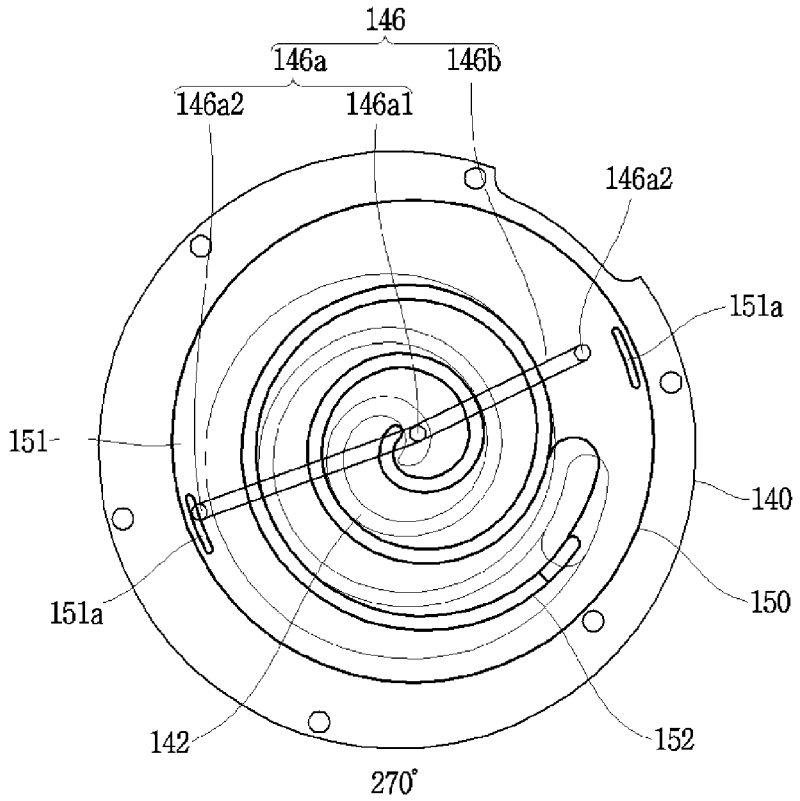
FIG. 10 is a planar view illustrating an example in which the orbiting scroll is disposed at a (fourth) position obtained by performing an orbital rotation from the position of FIG. 9 by a predetermined angle relative to the fixed scroll.

FIG. 7 is a planar view illustrating an example in which the orbiting scroll 150 is disposed at a (first) position relative to the fixed scroll 140. FIG. 8 is a planar view illustrating an example in which the orbiting scroll 150 is disposed at a (second) position obtained by performing an orbital rotation from the position of FIG. 7 by a predetermined angle relative to the fixed scroll 140. FIG. 9 is a planar view illustrating an example in which the orbiting scroll 150 is disposed in a (third) position obtained by performing an orbital rotation from the position of FIG. 8 by a predetermined angle relative to the fixed scroll 140. FIG. 10 is a planar view illustrating an example in which the orbiting scroll 150 is disposed at a (fourth) position obtained by performing an orbital rotation from the position of FIG. 9 by a predetermined angle relative to the fixed scroll 140.

Referring to FIGS. 7 to 10, configuration and disposition positions of the end plate groove 151*a* in the orbiting end plate 151 and the back pressure hole 146 according to an orbital rotation of the orbiting scroll 150 relative to the fixed scroll 140 are described. Referring to FIG. 7, the orbiting scroll 150 is disposed at a (first) position relative to the fixed scroll 140. The end plate groove 151*a* in the orbiting scroll 150 is spaced apart from the back pressure communication flow path 146*a*2 of the fixed scroll 140 with reference to a section.

Referring to FIG. 8, the orbiting scroll 150 is disposed at a (second) position obtained by performing an orbital rotation from the position of FIG. 7 by a predetermined angle relative to the fixed scroll 140. The end plate groove 151*a* on a right (first lateral) side of the orbiting scroll 150 with reference to a cross-section is disposed to communicate with the back pressure communication flow path 146*a*2 of the fixed scroll 140 with reference to the cross-section. In addition, it may be understood that placement of the orbiting scroll 150 in FIG. 8 is obtained by performing an orbital rotation by an angle of 90° relative to the fixed scroll 140 with reference to the position of FIG. 7.

Referring to FIG. 9, the orbiting scroll 150 is disposed at a (third) position obtained by performing an orbital rotation from the position of FIG. 7 relative to the fixed scroll 140 by a predetermined angle. The end plate groove 151*a* on a left (second lateral) side of the orbiting scroll 150 with reference to a cross-section is disposed to communicate with the back pressure communication flow path 146*a*2 of the fixed scroll 140 with reference to the cross-section. In addition, it may be understood that placement of the orbiting scroll 150 in FIG. 9 is obtained by performing an orbital rotation by an angle of 180° relative to the fixed scroll 140 with reference to the position of FIG. 7.

Referring to FIG. 10, the orbiting scroll 150 is disposed at a (fourth) position obtained by performing an orbital rotation from the position of FIG. 7 by a predetermined angle relative to the fixed scroll 140. The end plate groove 151*a* in the orbiting scroll 150 with reference to a cross-section is spaced apart from the back pressure communication flow path 146*a*2 of the fixed scroll 140 with reference to the cross-section. In addition, it may be understood that placement of the orbiting scroll 150 in FIG. 10 is obtained by performing an orbital rotation by an angle of 270° relative to the fixed scroll 140 with reference to the position of FIG. 7.

Figure 11:
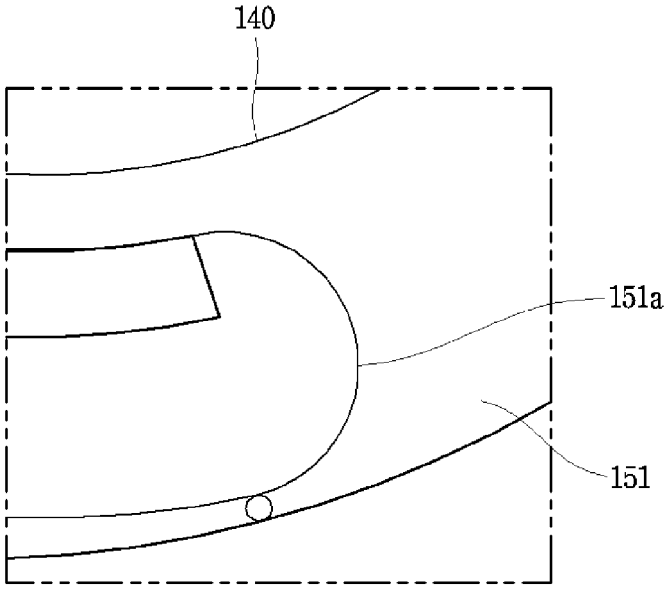
FIG. 11 is a partially enlarged view illustrating an example in which an end plate groove is disposed at an outermost side of an orbiting end plate of the orbiting scroll as possible in a state when a sealing distance is ensured.

FIG. 11 is a partially enlarged view illustrating an example in which the end plate groove 151*a* is disposed at an outermost side of the orbiting end plate 151 of the orbiting scroll 150 as possible in a state when a sealing distance is ensured. FIG. 11 illustrates an example of a case when the end plate groove 151*a* in the orbiting scroll 150 is processed. In practice, when there is a limit in a diameter of the end plate groove 151*a*, a groove may be designed only in a particular region as shown in the example. However, in particular cases, when there is no limit in a size of an outer diameter of the orbiting end plate 151 of the orbiting scroll 150, and when a sealing distance from a compression portion of the fixed scroll 140 of FIG. 11 is ensured, the end plate groove 151*a* may have a donut shape positioned at an outermost portion of the orbiting end plate 151 of the orbiting scroll 150. The example in which the back pressure hole 146 is disposed on a left side of the fixed scroll 140 was described above with reference to FIG. 3.

Figure 12:
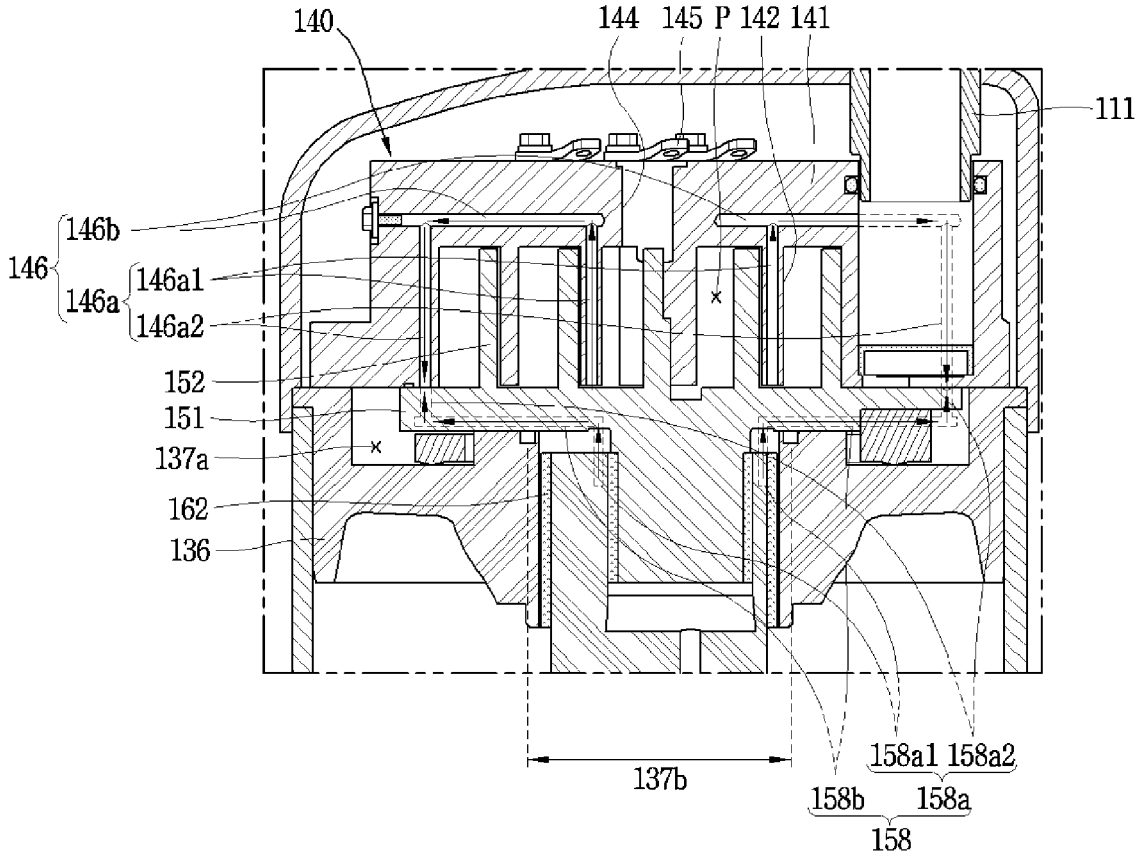
FIG. 12 is an enlarged cross-sectional view illustrating an example in which a back pressure hole is disposed on both sides of the fixed scroll and a back pressure opening is disposed on both sides of the orbiting scroll, each in the scroll compressor according to an embodiment.
Figure 13:
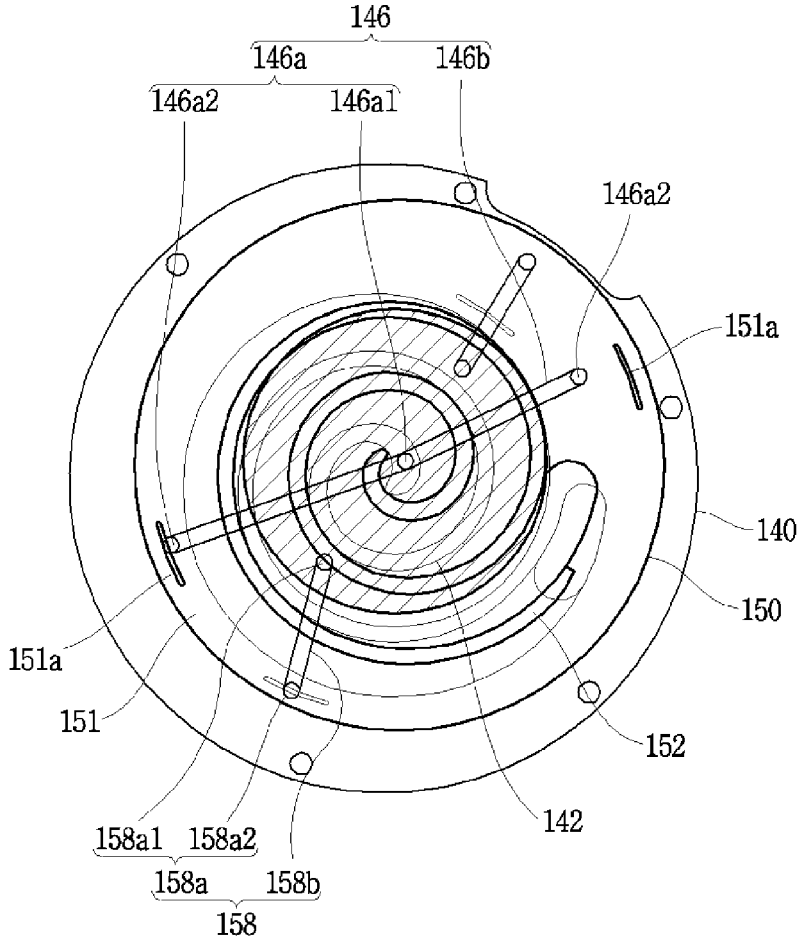
FIG. 13 is a planar view of the scroll compressor of FIG. 12.

FIG. 12 is an enlarged cross-sectional view illustrating an example in which the back pressure hole 146 is disposed on both sides of the fixed scroll 140 and the back pressure opening 158 is disposed on both sides of the orbiting scroll 150, each in the scroll compressor 100 according to embodiments disclosed herein. FIG. 13 is a planar view of the illustration of FIG. 12.

Hereinafter, referring to FIGS. 12 and 13, the scroll compressor 100 in an example in which the back pressure hole 146 is disposed on both sides of the fixed scroll 140 and the back pressure opening 158 is disposed on both sides of the orbiting scroll 150 described hereinafter.

FIG. 12 illustrates an example in which the back pressure hole 146 is parallel to an upward direction and the first flow path 146*a* is disposed respectively on left and right or lateral sides of the fixed scroll 140. In addition, an example in which the first flow path 146*a* on each of the left and right sides includes the compression communication flow path 146*a*1 into which gas discharged from the compression chamber P flows and the back pressure communication flow path 146*a*2 disposed to communicate with the first back pressure chamber 137*a* is illustrated.

As such, in scroll compressor 100 shown in FIG. 12, the first flow path 146*a* including the compression communication flow path 146*a*1 and the back pressure communication flow path 146*a*2 is disposed respectively on the left and right sides of the fixed scroll 140. In addition, the compression communication flow path 146*a*1 is disposed on left and right inner sides of the fixed scroll 140 which is adjacent to rotational shaft 160. The compression communication flow path 146*a*1 disposed respectively on the left and right inner sides of the fixed scroll 140 allows gas discharged from the compression chamber P to be introduced therein, and allows the introduced gas to flow into the second flow path 146*b*. The compression communication flow path 146*a*1 may allow the gas discharged from the compression chamber P to flow upwards.

In addition, although not explicitly illustrated in FIGS. 12 and 13, the compression communication flow path 146*a*1 of FIGS. 12 and 13 may be understood as having a micro-hole shape with a predetermined diameter as illustrated in FIG. 4.

The second flow path 146*b* may be defined between the compression communication flow path 146*a*1 and the back pressure communication flow path 146*a*2. An example in which the second flow path 146*b* is defined in a left-right or lateral direction to communicate the compression communication flow path 146*a*1 with the back pressure communication flow path 146*a*2 in upper left and right or lateral portions of the fixed scroll 140, FIGS. 12 and 13 illustrate an example in which the second flow path 146*b* is disposed in the upper left and right portions of the fixed scroll 140, the second flow path 146*b* in each of the upper left and right portions of the fixed scroll 140 extends between the compression communication flow path 146*a*1 and the back pressure communication flow path 146*a*2, and has a minute circular cross-section extending in an upper portion of the fixed scroll 140. However, embodiments are not limited to circular section.

The back pressure communication flow path 146*a*2 communicates with the second flow path 146*b* and is disposed in parallel with the compression communication flow path 146*a*1. In addition, the back pressure communication flow path 146*a*2 may be disposed at one position adjacent to an outer circumference of the orbiting end plate 151 in each of the left and right portions of the fixed scroll 140. As illustrated in FIG. 12, the back pressure communication flow path 146*a*2 allows gas supplied from the second flow path 146*b* in each of the left and right portions to flow downward to be provided to the first back pressure chamber 137*a*. In addition, FIGS. 12 and 13 shows an example in which the back pressure communication flow path 146*a*2 is disposed at one position near an outer circumference of the orbiting end plate 151, that is, an outer portion compared to the compression communication flow path 146*a*1.

With reference to a cross-section, the second back pressure chamber 137*b* having a width corresponding to a predetermined distance from a center of the orbiting end plate 151 may be disposed near a center of the main frame 130 below the orbiting end plate 151. The back pressure opening 158 described hereinafter may communicate with the second back pressure chamber 137*b*. In addition, the back pressure opening 158 in communication with the second back pressure chamber 137*b* and a lower surface of the fixed scroll 140 may be disposed in the orbiting end plate 151.

The back pressure opening 158 may include first and second passages 158*a* and 158*b*. The first passage 158*a* may be disposed or extend in a direction parallel to an upward direction. The second passage 158*b* may be disposed to communicate with the first passage 158*a* in a direction parallel to a lateral direction.

The first passage 158*a* may include a back pressure chamber communication flow path 158*a*1 and a fixed communication flow path 158*a*2. Gas discharged from the second back pressure chamber 137*b* flows into the back pressure chamber communication flow path 158*a*1. That is, the back pressure chamber communication flow path 158*a*1 may be understood as an inlet into which the gas discharged from the second back pressure chamber 137*b* flows.

The fixed communication flow path 158*a*2 communicates with the back pressure chamber communication flow path 158*a*1 and is configured to communicate with a lower surface of the fixed scroll 140 to be capable of providing gas flowing through the back pressure chamber communication flow path 158*a*1 to the lower surface of the fixed scroll 140.

As described above, the second passage 158*b* is configured to be capable of communicating with the first passage 158*a*. FIG. 12 illustrates an example in which the second passage 158*b* is configured to be capable of communicating with the back pressure chamber communication flow path 158*a*1 and the fixed communication flow path 158*a*2.

In addition, FIG. 12 shows an example in which the back pressure opening 158 communicating with the second back pressure chamber 137*b* and the lower surface of the fixed scroll 140 is disposed on a lower surface of the orbiting end plate 151. The back pressure opening 158 is disposed on each of left and right or lateral sides of the orbiting end plate 151.

FIG. 12 illustrates the first passage 158*a* extending in a direction parallel with an upward direction and the second passage 158*b* extending in a direction parallel with a lateral direction are disposed on a left (first) side of a lower surface of the orbiting end plate 151. In addition, it is illustrated that the first passage 158*a* extending in a direction parallel with an upward direction and the second passage 158*b* extending in a direction parallel with a lateral direction are disposed on a right (second) side of the lower surface of the orbiting end plate 151.

In addition, the first passage 158*a* may include the back pressure chamber communication flow path 158*a*1 and the fixed communication flow path 158*a*2. Thus, an example in which the back pressure chamber communication flow path 158*a*1, the second passage 158*b*, and the fixed communication flow path 158*a*2 are disposed on the left side of the lower surface of the orbiting end plate 151, and the back pressure chamber communication flow path 158*a*1, the second passage 158*b*, and the fixed communication flow path 158*a*2 are disposed on the right side of the lower surface of the orbiting end plate 151 is shown.

Figure 14:
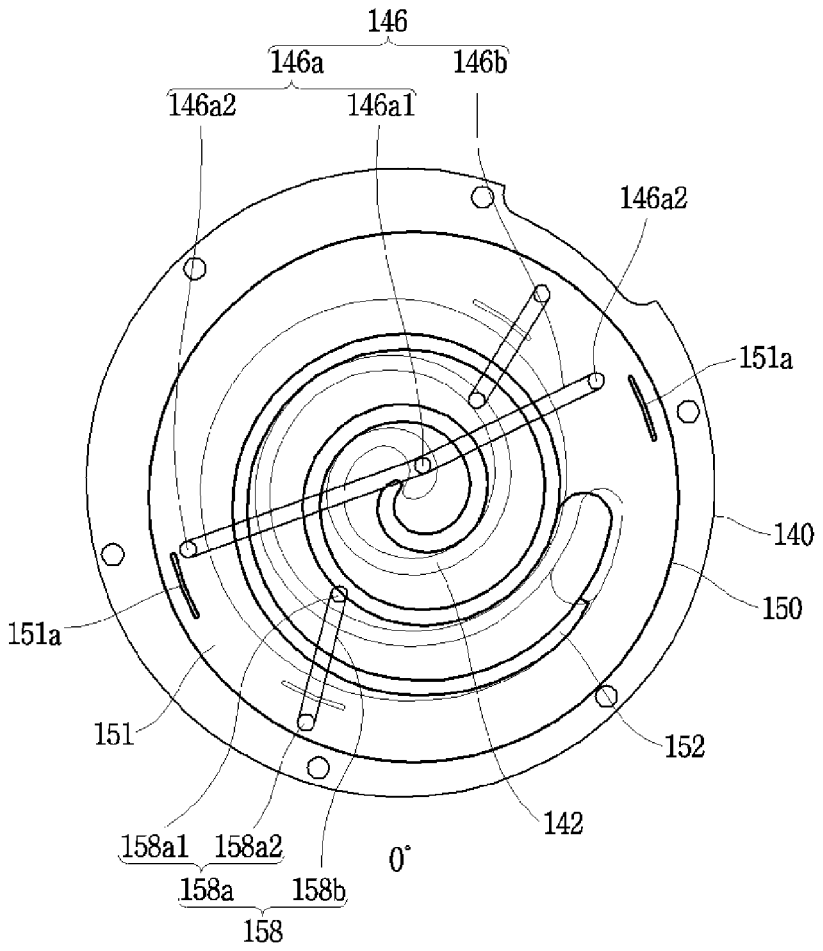
FIG. 14 is a planar view illustrating an example in which the orbiting scroll is disposed at a (first) position relative to the fixed scroll in the scroll compressor of FIG. 12.
Figure 15:
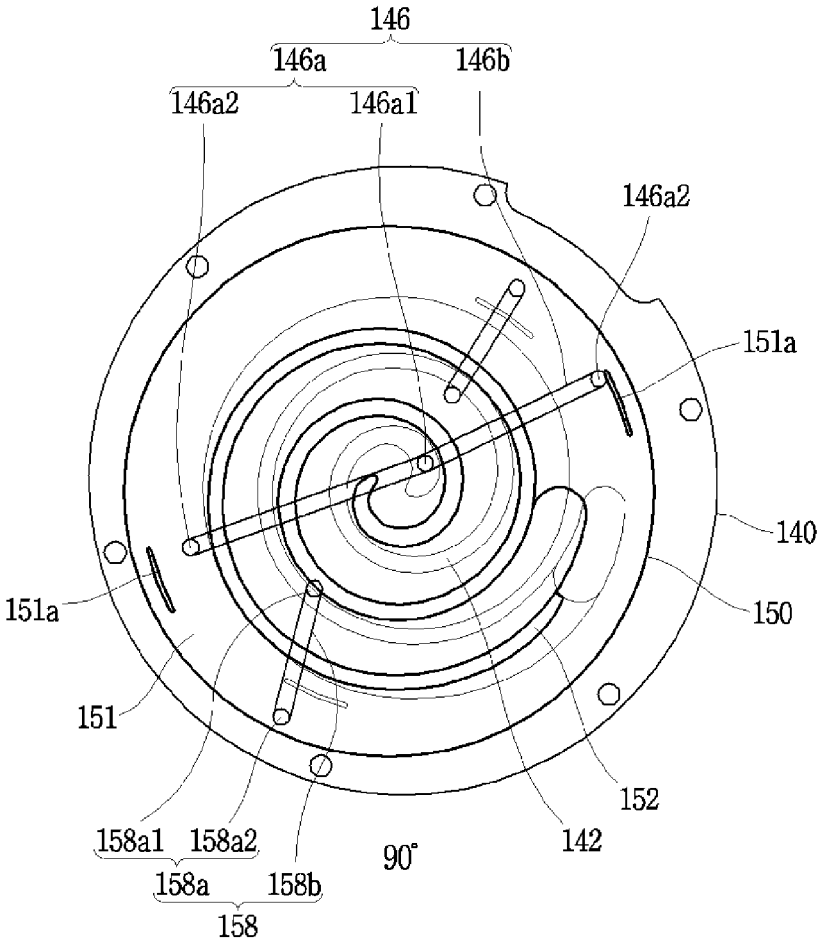
FIG. 15 is a planar view illustrating an example in which the orbiting scroll is disposed at a (second) position obtained by performing an orbital rotation from the position of FIG. 14 by a predetermined angle relative to the fixed scroll.
Figure 16:
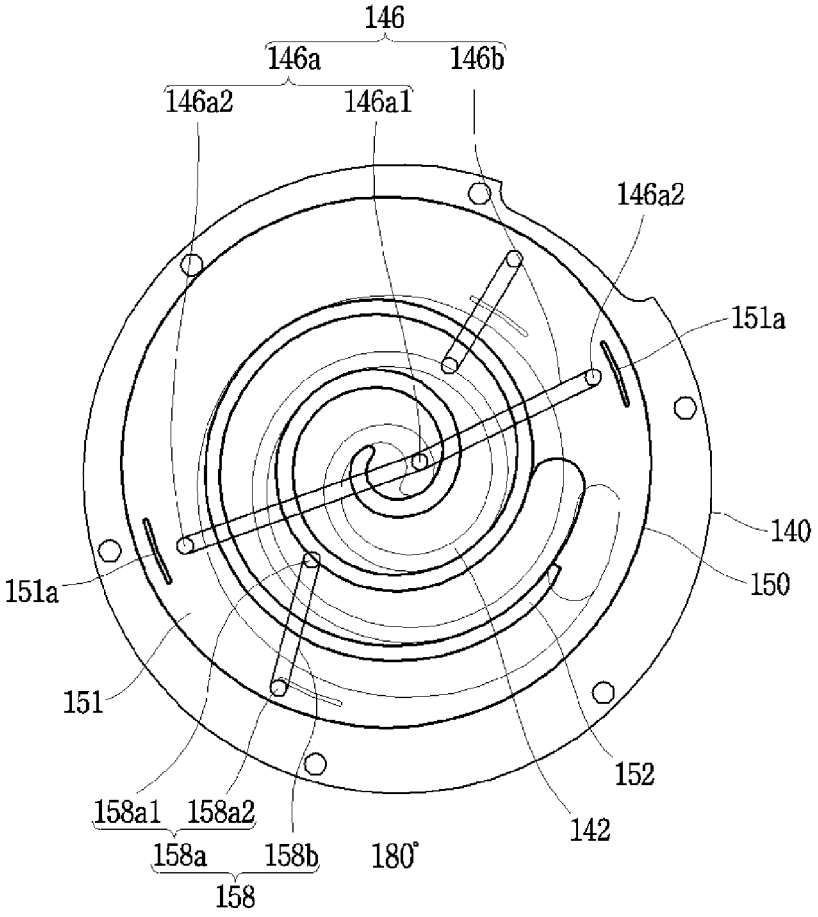
FIG. 16 is a planar view illustrating an example in which the orbiting scroll is disposed at a (third) position obtained by performing an orbital rotation from the position of FIG. 15 by a predetermined angle relative to the fixed scroll.
Figure 17:
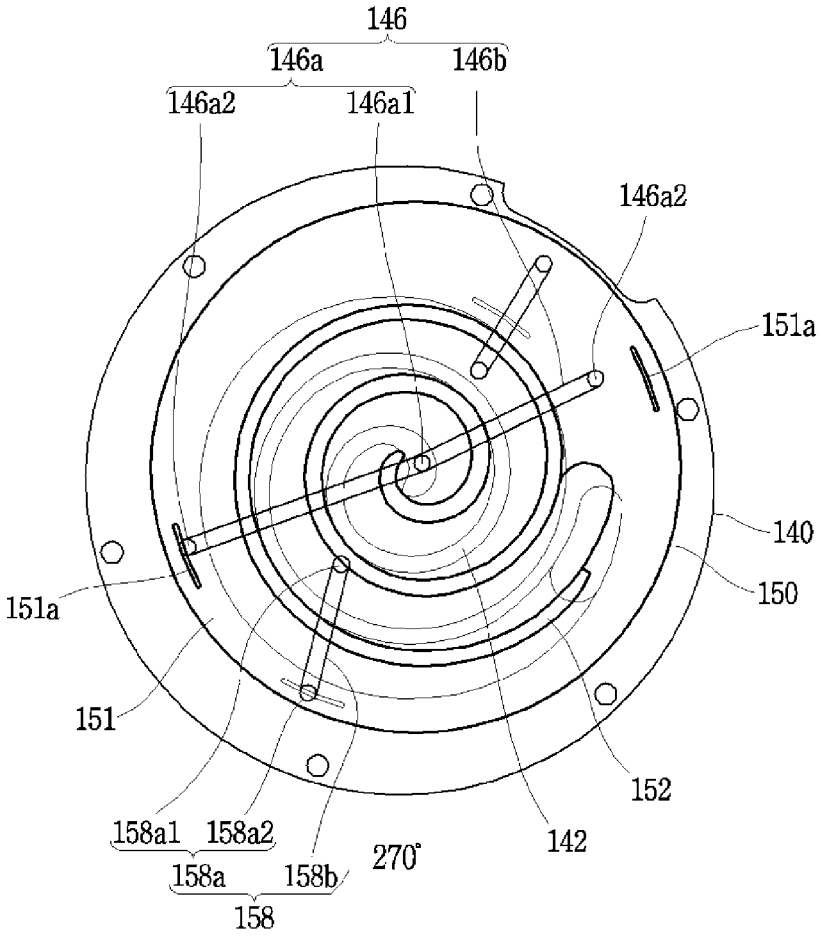
FIG. 17 is a planar view illustrating an example in which the orbiting scroll is disposed at a (fourth) position obtained by performing an orbital rotation from the position of FIG. 16 by a predetermined angle relative to the fixed scroll.

FIG. 14 is a planar view illustrating an example in which the orbiting scroll 150 is disposed at a (first) position relative to the fixed scroll 140 in the scroll compressor 100 of FIG. 12. FIG. 15 is a planar view illustrating an example in which the orbiting scroll 150 is disposed at a (second) position obtained by performing an orbital rotation from the position of FIG. 14 by a predetermined angle relative to the fixed scroll 140. FIG. 16 is a planar view illustrating an example in which the orbiting scroll 150 is disposed at a (third) position obtained by performing an orbital rotation from the position of FIG. 15 by a predetermined angle relative to the fixed scroll 140. FIG. 17 is a planar view illustrating an example in which the orbiting scroll 150 is disposed at a (fourth) position obtained by performing an orbital rotation from the position of FIG. 16 by a predetermined angle relative to the fixed scroll 140.

Referring to FIGS. 14 to 17, configuration and disposition positions of the end plate groove 151*a* in the orbiting end plate 151, the back pressure hole 146, and back pressure opening 158, each described above, according to an orbital rotation of the orbiting scroll 150 relative to the fixed scroll 140 are described. FIGS. 14 to 17 illustrate an example in which the back pressure opening 158 including the first and second passages 158*a* and 158*b* in the orbiting scroll 150 is disposed in two portions such as a lower left (first) portion and an upper right (second) portion with reference to a center of the orbiting scroll 150 to be in parallel with an upward-downward direction in the drawing.

Referring to FIG. 14, the orbiting scroll 150 is disposed at a (first) position relative to the fixed scroll 140. The end plate groove 151*a* in the orbiting scroll 150 is spaced apart from the back pressure communication flow path 146*a*2 of the fixed scroll 140 with reference to a section.

Referring to FIG. 15, the orbiting scroll 150 is disposed at a (second) position obtained by performing an orbital rotation from the position of FIG. 14 by a predetermined angle relative to the fixed scroll 140. The end plate groove 151*a* on a right (first) side of the orbiting scroll 150 with reference to a cross-section is disposed to communicate with the back pressure communication flow path 146*a*2 of the fixed scroll 140 with reference to the cross-section. In addition, it may be understood that placement of the orbiting scroll 150 in FIG. 15 is obtained by performing an orbital rotation by an angle of 90° relative to the fixed scroll 140 with reference to the position of FIG. 14.

Referring to FIG. 16, the orbiting scroll 150 is disposed at a (third) position obtained by performing an orbital rotation from the position of FIG. 14 by a predetermined angle relative to the fixed scroll 140. The end plate groove 151*a* in a left (second) side of the orbiting scroll 150 is disposed to communicate with the back pressure communication flow path 146*a*2 of the fixed scroll 140 with reference to a cross-section. In addition, it may be understood that placement of the orbiting scroll 150 in FIG. 16 is obtained by performing an orbital rotation by an angle of 180° relative to the fixed scroll 140 with reference to the position of FIG. 14.

Referring to FIG. 17, the orbiting scroll 150 is disposed at a (fourth) position obtained by performing an orbital rotation from the position of FIG. 14 by a predetermined angle relative to the fixed scroll 140. The end plate groove 151*a* in the orbiting scroll 150 with reference to a cross-section is spaced apart from the back pressure communication flow path 146*a*2 of the fixed scroll 140 with reference to the cross-section. In addition, it may be understood that placement of the orbiting scroll 150 in FIG. 17 is obtained from performing an orbital rotation by an angle of 270° relative to the fixed scroll 140 with reference to the position of FIG. 14.

The guide inlet portion 147*c* configured to communicate with the back pressure hole 146 and guide the discharged gas to flow into the first back pressure chamber 137*a* may be disposed on a lower surface of the fixed scroll 140.

Figure 18:
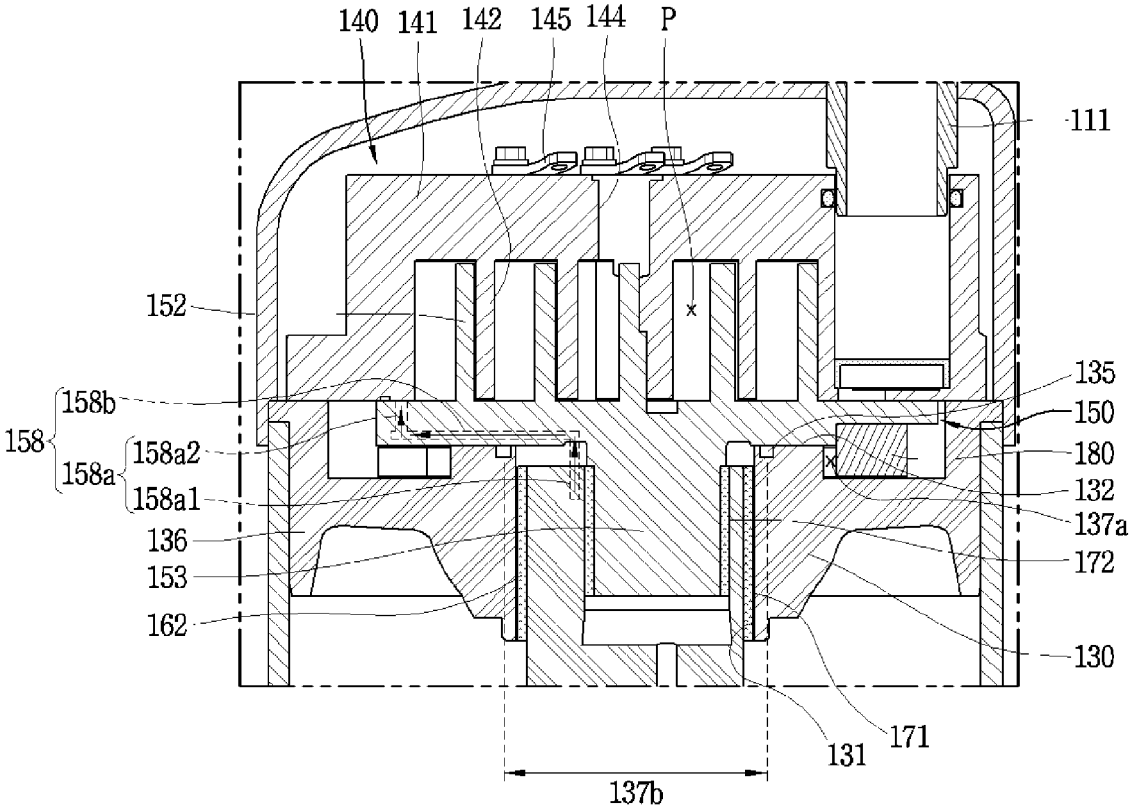
FIG. 18 is an enlarged sectional view illustrating an example in which a back pressure hole is disposed not in the fixing scroll, but in the orbiting scroll in the scroll compressor according to an embodiment.
Figure 19:
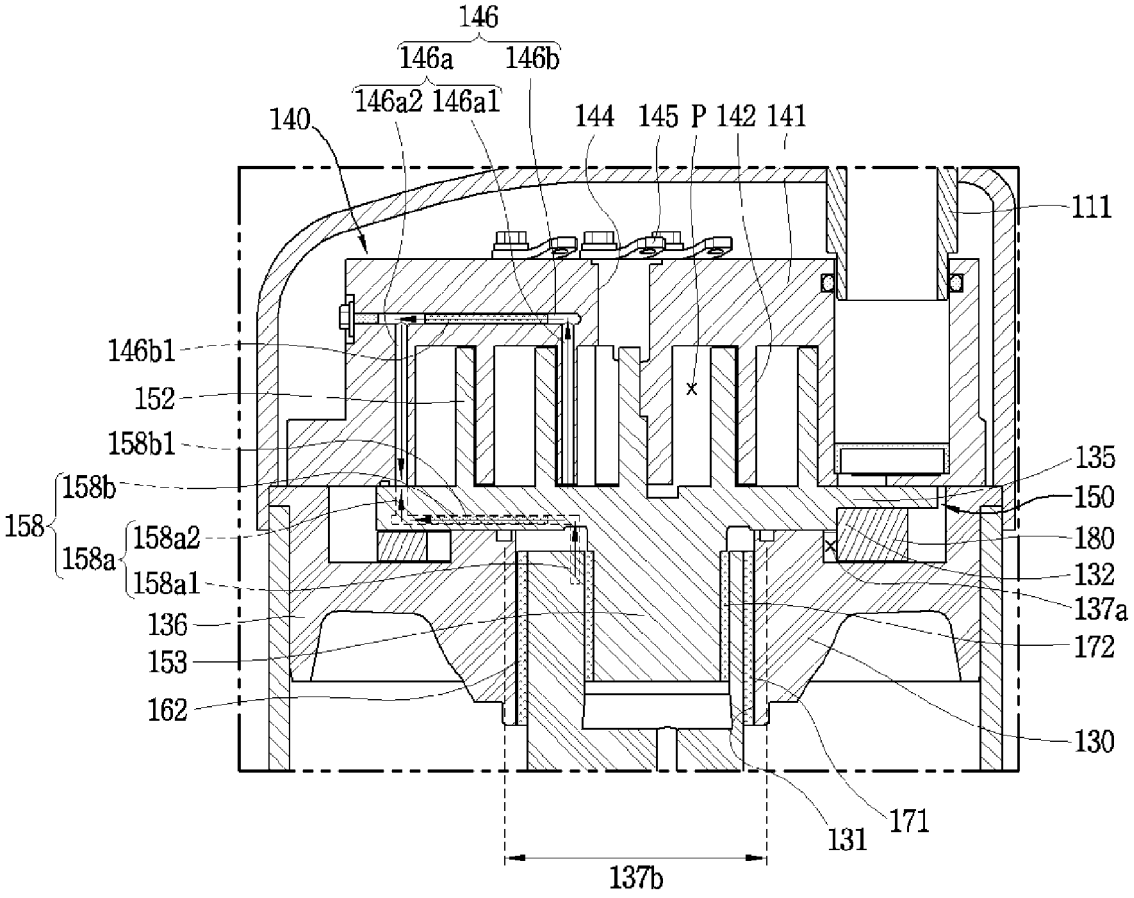
FIG. 19 is an enlarged cross-sectional view illustrating an example in which pressure control pins are equipped in the fixed scroll and the orbiting scroll, respectively.
Figure 20:
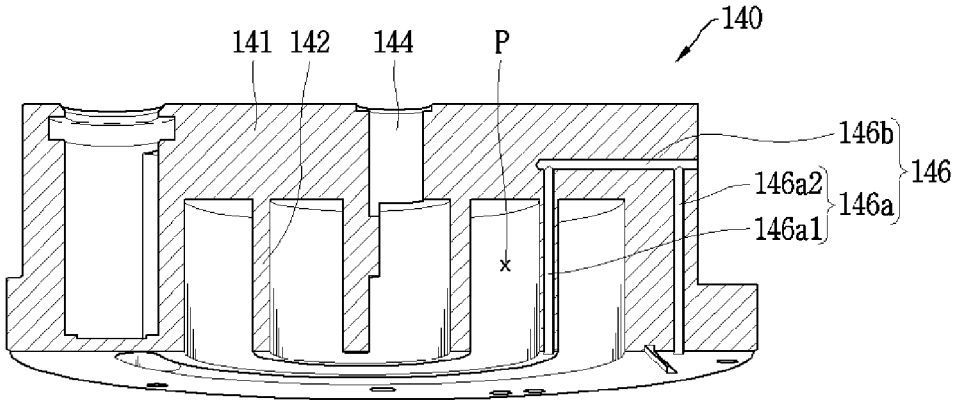
FIG. 20 is a cross-sectional view illustrating the fixed scroll and the orbiting scroll each in which the back pressure hole is disposed.

FIG. 18 is an enlarged cross-sectional view illustrating an example in which the back pressure hole 146 is disposed not in the fixing scroll 140, but in the orbiting scroll 150 in the scroll compressor 100 according to an embodiment. FIG. 19 is an enlarged cross-sectional view illustrating an example in which pressure control pins 146*b*1 and 158*b*1 are disposed in the fixed scroll 140 and the orbiting scroll 150, respectively. FIG. 20 is a cross-sectional view illustrating the fixed scroll 140 having the back pressure hole 146 defined therein, and the orbiting scroll 150.

FIG. 18 shows an example of the scroll compressor 100 in which the back pressure hole 146 is not defined in the fixed scroll 140. The back pressure opening 158 described above may communicate with the second back pressure chamber 137*b* in the scroll compressor 100 shown in FIG. 18.

In addition, an example in which the back pressure openings 158 in communication with the second back pressure chamber 137*b* and the lower surface of the fixed scroll 140 may be disposed on the left side of the orbiting end plate 151.

The back pressure opening 158 may include first and second passages 158*a* and 158*b*. The first passage 158*a* may be disposed or extend in a direction parallel to an upward direction. The second passage 158*b* may be disposed to communicate with the first passage 158*a* or extend in a direction parallel to a lateral direction.

The first passage 158*a* may include a back pressure chamber communication flow path 158*a*1 and a fixed communication flow path 158*a*2. Gas discharged from the second back pressure chamber 137*b* flows into the back pressure chamber communication flow path 158*a*1. That is, the back pressure chamber communication flow path 158*a*1 may be understood as an inlet into which the gas discharged from the second back pressure chamber 137*b* flows.

The fixed communication flow path 158*a*2 communicates with the back pressure chamber communication flow path 158*a*1 and is configured to communicate with a lower surface of the fixed scroll 140 to be capable of providing gas flowing through the back pressure chamber communication flow path 158*a*1 to the lower surface of the fixed scroll 140. As described above, the second passage 158*b* is configured to be capable of communicating with the first passage 158*a*. FIG. 18 illustrates an example in which the second passage 158*b* is configured to be capable of communicating with the back pressure chamber communication flow path 158*a*1 and the fixed communication flow path 158*a*2.

FIG. 19 shows the scroll compressor 100 according to one example in which the back pressure hole 146 is disposed on the left side of the fixed scroll 140 and the back pressure opening 158 is disposed on the left side of the orbiting scroll 150. Further, referring to FIG. 19, the pressure control pin 146*b*1 is disposed in the second flow path 146*b* of the back pressure hole 146 described above. A flow of gas into the first back pressure chamber 137*a* may be controlled by the pressure control pin 146*b*1 disposed in the second flow path 146*b*. Furthermore, referring to FIG. 19, the pressure control pin 158*b*1 is disposed in the second passage 158*b* of the back pressure opening 158 described above. Gas leaked from the second back pressure chamber 137*b* may be controlled by the pressure control pin 158*b*1 equipped in the second passage 158*b*. That is, a sudden flow of high-pressure gas into the back pressure chamber may be prevented by the pressure control pins 146*b*1 and 158*b*1.

According to embodiments disclosed herein, pressure in the back pressure chambers 137*a* and 137*b* in a high-pressure scroll compressor may be varied according to operating conditions using the structure described above. In the scroll compressor 100 according to embodiments disclosed herein, as the orbiting scroll 150 actively moves in the axial direction according to a relationship of forces between the back pressure chambers 137*a* and 137*b* and the compression chamber P regardless of operating conditions, constant performance may be exhibited in most operating regions.

In the scroll compressor 100 according to embodiments disclosed herein, as described above, although the back pressure hole 146 in an upper portion of the fixed wrap 142 is adjacent to the first back pressure chamber 137*a*, the back pressure hole 146 and the first back pressure chamber 137*a* communicate with each other via the back pressure communication flow path 146*a*2, that is, a hole in an outer portion in the fixed scroll 140, that is, a hole drilled in a position closed by rotation of the orbiting scroll 150 at all times. Thus, while the compressor is driven, when the orbiting scroll 150 moves backward in the axial direction due to lower pressure in the first back pressure chamber 137*a*, a gap is generated between an upper end of the wrap 142 of the fixed scroll 140 and a bottom portion of the orbiting scroll 150. When high-pressure gas flows into the first back pressure chamber 137*a* through the gap. Pressure in the first back pressure chamber 137*a* rises and the orbiting scroll 150 moves in the axial direction, thus maintaining sealing in the compression chamber P to thereby increase efficiency of the scroll compressor 100.

The aforementioned scroll compressor 100 is not limited to the configuration and the method of the embodiments described above, but the embodiments may be configured such that all or some of the embodiments are selectively combined so that various modifications can be made.

It will be apparent to those skilled in the art that the embodiments disclosed herein may be embodied in other specific forms without departing from the spirit or essential characteristics thereof. Therefore, it should also be understood that the above-described embodiments are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

INDUSTRIAL AVAILABILITY

Embodiments disclosed herein may be used for a scroll compressor having structure such that pressure in a back pressure chamber is varied according to operating conditions in a high-pressure scroll compressor.

The invention claimed is:

1. A scroll compressor, comprising:

an orbiting scroll configured to perform an orbital motion;

a fixed scroll coupled to the orbiting scroll to define a compression chamber; and a main frame that rotatably support the orbiting scroll at an opposite side of the fixed scroll with the orbiting scroll interposed therebetween, the main frame supporting the fixed scroll, wherein the fixed scroll is provided with a back pressure hole disposed between the compression chamber and a first back pressure chamber in which gas discharged from the compression chamber is received, wherein the back pressure hole is configured to communicate with the first back pressure chamber and the compression chamber on a basis of a predetermined pressure ratio of the compression chamber, wherein the orbiting scroll comprises an orbiting end plate having a disc shape with a predetermined width, the orbiting end plate supporting the fixed scroll, wherein at least one end plate groove is disposed at a side portion of one surface of the orbiting end plate along a circumferential direction, and wherein the at least one end plate groove is disposed at a position at which the at least one end plate groove is capable of communicating with the back pressure hole during an orbiting motion of the orbiting scroll, wherein the at least one end plate groove comprises a plurality of end plate grooves provided on the one surface of the orbiting end plate, wherein the plurality of end plate grooves is disposed at both sides with respect to a center of the orbiting end plate, wherein a distance from a first side of each of the plurality of end plate grooves to an outer portion of the compression chamber is greater than a distance from a second side of each of the plurality of end plate grooves to an outer circumference of the orbiting end plate, and wherein each of the plurality of end plate grooves is disposed adjacent to the outer circumference of the orbiting end plate and spaced apart therefrom by a sealing distance.

2. The scroll compressor of claim 1, wherein the back pressure hole comprises:

a first flow path that extends in a direction parallel to a vertical direction; and a second flow path that communicates with the first flow path and extends in a direction parallel to a lateral direction.

3. The scroll compressor of claim 2, wherein the first flow path comprises:

a compression communication flow path into which the gas discharged from the compression chamber flows; and a back pressure communication flow path that communicates with the compression communication flow path and the first back pressure chamber to provide gas flowing through the compression communication flow path into the first back pressure chamber.

4. The scroll compressor of claim 3, wherein the second flow path is disposed between the compression communication flow path and the back pressure communication flow path.

5. The scroll compressor of claim 3, wherein a guide inlet that is configured to guide the discharged gas to flow into the first back pressure chamber and communicates with the back pressure hole is disposed on a lower surface of the fixed scroll.

6. The scroll compressor of claim 3, wherein the second flow path comprises a pressure control pin configured to control a flow of the gas into the first back pressure chamber.

7. The scroll compressor of claim 2, wherein the first and second flow paths are disposed on an inner portion of the fixed scroll with reference to an outer diameter of the orbiting end plate.

8. The scroll compressor of claim 2, wherein a second back pressure chamber having a width corresponding to a predetermined distance from the center of the orbiting end plate is disposed below the orbiting end plate, and wherein a back pressure opening in communication with the second back pressure chamber and a lower surface of the fixed scroll is disposed in the orbiting end plate.

9. The scroll compressor of claim 8, wherein the back pressure opening comprises:

a first passage that extends in a direction parallel to the vertical direction; and a second passage that is configured to communicate with the first passage and that extends in a direction parallel to the lateral direction.

10. The scroll compressor of claim 9, wherein the first passage comprises:

a back pressure chamber communication flow path into which gas discharged from the second back pressure chamber flows; and a fixed communication flow path that communicates with the back pressure chamber communication flow path, and configured to communicate with the lower surface of the fixed scroll to provide gas flowing through the back pressure chamber communication flow path to the lower surface of the fixed scroll.

11. The scroll compressor of claim 10, wherein a fixing groove is disposed in the lower surface of the fixed scroll configured to communicate with the fixed communication flow path.

12. The scroll compressor of claim 9, wherein a pressure control pin configured to control gas leakage from the second back pressure chamber is disposed in the second passage.

13. The scroll compressor of claim 1, wherein the first back pressure chamber is disposed between an upper surface of the main frame, a side portion of the orbiting scroll, and a lower surface of the fixed scroll.

14. The scroll compressor of claim 1, wherein the plurality of end plate grooves is disposed to be symmetrical to each other with respect to the center of the orbiting end plate.

15. The scroll compressor of claim 1, wherein as pressure outside of the fixed scroll is decreased, when the orbiting scroll moves backward in an axial direction, gas flows into the plurality of end plate grooves and pressure in the first back pressure chamber rises pressing the orbiting end plate in an axial direction to be coupled to the fixed scroll.

16. A scroll compressor, comprising:

an orbiting scroll configured to perform an orbital motion;

a fixed scroll coupled to the orbiting scroll to define a compression chamber;

a main frame configured to rotatably support the orbiting scroll at an opposite side of the fixed scroll with the orbiting scroll interposed therebetween, the main frame supporting the fixed scroll; and a casing in which the orbiting scroll, the fixed scroll, and the main frame are disposed, wherein the fixed scroll is provided with a back pressure hole disposed between the compression chamber and a first back pressure chamber in which gas discharged from the compression chamber is received, wherein the back pressure hole is configured to communicate with the first back pressure chamber and the compression chamber on a basis of a predetermined pressure ratio of the compression chamber, wherein the orbiting scroll comprises an orbiting end plate having a disc shape with a predetermined width, the orbiting end plate supporting the fixed scroll, wherein at least one end plate groove is disposed at a side portion of one surface of the orbiting end plate along a circumferential direction, wherein the at least one end plate groove is disposed at a position at which the at least one end plate groove is configured to communicate with the back pressure hole during an orbiting motion of the orbiting scroll, wherein the at least one end plate groove comprises a plurality of end plate grooves provided on the one surface of the orbiting end plate, wherein the plurality of end plate grooves is disposed at both sides with respect to a center of the orbiting end plate, wherein a distance from a first side of each of the plurality of end plate grooves to an outer portion of the compression chamber is greater than a distance from a second side of each of the plurality of end plate grooves to an outer circumference of the orbiting end plate, and wherein each of the plurality of end plate grooves is disposed adjacent to the outer circumference of the orbiting end plate and spaced apart therefrom by a sealing distance.

17. The scroll compressor of claim 16, wherein the back pressure hole comprises:

a first flow path that extends in a direction parallel to a vertical direction; and a second flow path configured to communicate with the first flow path and that extends in a direction parallel to a lateral direction.

18. The scroll compressor of claim 17, wherein the first flow path comprises:

a compression communication flow path into which the gas discharged from the compression chamber flows; and a back pressure communication flow path that communicates with the compression communication flow path and configured to communicate with the first back pressure chamber to provide gas flowing through the compression communication flow path into the first back pressure chamber.

19. The scroll compressor of claim 17, wherein a guide inlet configured to guide the discharged gas to flow into the first back pressure chamber and communicate with the back pressure hole is disposed on a lower surface of the fixed scroll.

20. The scroll compressor of claim 17, wherein the second flow path comprises a pressure control pin configured to control a flow of the gas into the first back pressure chamber.

21. The scroll compressor of claim 17, wherein the first and second flow paths are disposed on an inner portion of the fixed scroll with reference to an outer diameter of the orbiting end plate.

22. The scroll compressor of claim 17, wherein a second back pressure chamber having a width corresponding to a predetermined distance from the center of the orbiting end plate is disposed below the orbiting end plate, and wherein a back pressure opening in communication with the second back pressure chamber and a lower surface of the fixed scroll is disposed in the orbiting end plate.

23. The scroll compressor of claim 22, wherein the back pressure opening comprises:

a first passage that extends in a direction parallel to the vertical direction; and a second passage configured to communicate with the first passage and that extends in a direction parallel to the lateral direction.

24. The scroll compressor of claim 23, wherein the first passage comprises:

a back pressure chamber communication flow path into which gas discharged from the second back pressure chamber flows; and a fixed communication flow path that communicates with the back pressure chamber communication flow path, and configured to communicate with the lower surface of the fixed scroll to provide gas flowing through the back pressure chamber communication flow path to the lower surface of the fixed scroll.

25. The scroll compressor of claim 24, wherein a fixing groove is disposed in the lower surface of the fixed scroll and is configured to communicate with the fixed communication flow path.

* * * * *